US006581455B1

(12) United States Patent
Berger et al.

(10) Patent No.: US 6,581,455 B1
(45) Date of Patent: Jun. 24, 2003

(54) MODIFIED FORMATION TESTING APPARATUS WITH BOREHOLE GRIPPERS AND METHOD OF FORMATION TESTING

(75) Inventors: Per-Erik Berger, Sokn (NO); Volker Krueger, Celle (DE); Matthias Meister, Celle (DE); John M. Michaels, Houston, TX (US); Jaedong Lee, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 09/703,645

(22) Filed: Nov. 1, 2000

Related U.S. Application Data

(63) Continuation-in-part of application No. 09/302,888, filed on Apr. 30, 1999, now Pat. No. 6,157,893, which is a continuation of application No. 09/226,865, filed on Jan. 7, 1999, now abandoned, which is a continuation-in-part of application No. 09/088,208, filed on Jun. 1, 1998, now Pat. No. 6,047,239, which is a continuation-in-part of application No. 08/626,747, filed on Mar. 28, 1996, now Pat. No. 5,803,186, which is a continuation-in-part of application No. 08/414,558, filed on Mar. 31, 1995, now abandoned.

(51) Int. Cl.[7] ..... E21B 47/08; E21B 47/026; G01V 1/40

(52) U.S. Cl. ..... 73/152.55; 702/9; 175/50

(58) Field of Search ..... 73/152.55, 152.05, 73/152.26; 702/9; 166/264, 250.01; 175/50

(56) References Cited

U.S. PATENT DOCUMENTS

| | | | | | |
|---|---|---|---|---|---|
| 4,573,532 | A | * | 3/1986 | Blake | 166/264 |
| 4,635,717 | A | * | 1/1987 | Jageler | 166/250.01 |
| 4,860,580 | A | * | 8/1989 | DuRocher | 73/152.26 |
| 5,233,866 | A | * | 8/1993 | Desbrandes | 73/152.05 |
| 5,803,186 | A | * | 9/1998 | Berger et al. | 175/50 |
| 6,041,860 | A | * | 3/2000 | Nazzal et al. | 166/250.01 |
| 6,047,239 | A | * | 4/2000 | Berger et al. | 702/9 |
| 6,157,893 | A | * | 12/2000 | Berger et al. | 702/9 |

FOREIGN PATENT DOCUMENTS

| | | | | |
|---|---|---|---|---|
| WO | WO96/30628 | * | 10/1996 | E21B/49/10 |
| WO | WO99/45236 | * | 9/1999 | E21B/43/26 |

* cited by examiner

*Primary Examiner*—Helen Kwok
*Assistant Examiner*—Jay L Politzer
(74) *Attorney, Agent, or Firm*—Madan, Mossman & Sriram, P.C.

(57) ABSTRACT

An apparatus and method for obtaining samples of pristine formation or; formation fluid, using a work string designed for performing other downhole work such as drilling, workover operations, or re-entry operations. An extendable element extends against the formation wall to obtain the pristine formation or fluid sample. The apparatus includes at least one extendable gripper element for anchoring the apparatus during testing and sampling operations.

19 Claims, 16 Drawing Sheets

MODIFIED FORMATION TESTING APPARATUS WITH BOREHOLE GRIPPERS AND METHOD OF FORMATION TESTING

This is a continuation-in-part patent application of U.S. patent application Ser. No. 09/302,888 filed on Apr. 30, 1999, which issued as U.S. Pat. No, 6,157,893 on Dec. 5, 2000, and which is a continuation of U.S. patent application Ser. No. 09/226,865 filed on Jan. 7, 1999, and entitled "Modified Formation Testing Apparatus and Method" now abandoned, which is a continuation-in-part of U.S. patent application Ser. No. 09/088,208, filed on Jun. 1 1998, now U.S. Pat. No. 6,047,239 and entitled "Improved Formation Testing Apparatus and Method", which was a continuation-in-part patent application of U.S. patent application Ser. No. 08/626,747 [U.S. Pat. No. 5,803,186], filed on Mar. 28, 1996, and entitled "Formation Isolation and Testing Apparatus and Method", which was a continuation-in-part of U.S. patent application Ser. No. 08/414,558 filed on Mar. 31, 1995, and entitled "Method and Apparatus for Testing Wells", now abandoned. These applications are fully. incorporated herein by reference.

BACKGROUND OF THE INVENTION

1. Field of the Invention

This invention relates to the testing of underground formations or reservoirs. More particularly, this invention relates to a method and apparatus for isolating a downhole reservoir, and testing the reservoir formation and fluid.

2. Background

While drilling a well for commercial development of hydrocarbon reserves, several subterranean reservoirs and formations are encountered. In order to discover information about the formations, such as whether the reservoirs contain hydrocarbons, logging devices have been incorporated into drill strings to evaluate several characteristics of these reservoirs. Measurement-while-drilling systems (hereinafter MWD) have been developed that contain resistivity, nuclear and other logging devices which can constantly monitor formation and reservoir characteristics during drilling of wellbores. The MWD systems can generate data that includes information about the presence of hydrocarbon presence, saturation levels, and formation porosity. Telemetry systems have been developed for use with the MWD systems to transmit the data to the surface. A common telemetry method is the mud-pulsed system, an example of which is found in U.S. Pat. No. 4,733,233. MWD systems provide real time analysis of the subterranean reservoirs.

Commercial development of -hydrocarbon fields requires significant amounts of capital. Before field development begins, operators desire to have as much data as possible in order to evaluate the reservoir for commercial viability. Despite the advances in data acquisition during drilling, using the MWD systems, it is often necessary to conduct further testing of the hydrocarbon reservoirs in order to obtain additional data. Therefore, after the well has been drilled, the hydrocarbon zones are often tested by other test equipment.

One type of post-drilling test involves producing fluid from the reservoir, collecting samples, shutting-in the well and allowing the pressure to build-up to a static level. This sequence may be repeated several times for different reservoirs within a given borehole. This type of test is known as a "Pressure Build-up Test". One of the important aspects of the data collected during such a test is the pressure build-up information gathered after drawing the pressure down. From this data, information can be derived as to permeability, and size of the reservoir. Further, actual samples of the reservoir fluid are obtained, and tested to gather Pressure-Volume-Temperature data relevant to the reservoir's hydrocarbon distribution.

In order to perform these important tests, it is currently necessary to retrieve the drill string from the well borehole. Thereafter, a different tool, designed for the testing, is run into the well borehole. A wireline is often used to lower a test tool into the well borehole. The test tool sometimes utilizes packers for isolating the reservoir. Numerous communication devices have been designed which provide for manipulation of the test tool, or alternatively, provide for data transmission from the test tool. Some of those designs include signaling from the surface of the Earth with pressure pulses, through the fluid in the well borehole, to or from a downhole microprocessor located within, or associated with the test tool. Alternatively, a wire line can be lowered from the surface, into a landing receptacle located within a test tool, establishing electrical signal communication between the surface and the test assembly. Regardless of the type of test tool and type of communication system used, the amount of time and money required for retrieving the drill string and running a second test tool into the borehole is significant. Further, if the borehole is highly deviated, a wire line tool is difficult to use to perform the testing.

There is also another type of problem, related to downhole pressure conditions, which can occur during drilling. The density of the drilling fluid is calculated to achieve maximum drilling efficiency while maintaining safety, and the density is dependent upon the desired relationship between the weight of the drilling mud column and the downhole pressures which will be encountered. As different formations are penetrated during drilling, the downhole pressures can change significantly. Currently available devices do not accurately sense the formation pressure as the drill bit penetrates the formation. The actual formation pressure could be lower than expected, allowing the lowering of mud density, or the formation pressure could be higher than expected, possibly even resulting in a pressure kick Consequently, since this information is not easily available to the operator, the drilling mud may be maintained at too high or too. low a density for maximum efficiency and maximum safety.

Therefore, there is a need for a method and apparatus that will allow for the pressure testing and fluid sampling of potential hydrocarbon reservoirs as soon as the borehole has been drilled into the reservoir, without removal of the drill string. Further, there is a need for a method and apparatus that will allow for adjusting drilling fluid density in response to changes in downhole pressures to achieve maximum drilling efficiency. Finally, there is a need for a method and apparatus that will allow for blow out prevention downhole, to promote drilling safety.

SUMMARY OF THE INVENTION

A formation testing method and a test apparatus are disclosed. The test apparatus is mounted on a work string for use in a well borehole filled with fluid. It can be a work string designed for drilling, re-entry work, or workover applications. As required for many of these applications, the work string may be one capable of going into highly deviated holes, horizontally, or even uphill. Therefore, in order to be fully useful to accomplish the purposes of the present invention, the work string must be one that is capable of being forced into the hole, rather than being dropped like a wireline. The work string can contain a Measurement While Drilling (MWD) system and a drill bit, or other operative elements. The formation test apparatus may include at least one expandable packer or other extendable structure that can expand or extend to contact the wall of the well borehole; device for moving fluid such as a pump, for taking in formation -fluid; a non-rotating sleeve; an extendable stabilizer blade; a coring device, and at least one sensor for measuring a characteristic of the fluid or the formation. The test apparatus will also contain a controller, for controlling the various valves or pumps which are used to control fluid flow. The sensors and other instrumentation and control equipment must be carried by the tool. The tool must have a communication system capable of communicating with the surface, and data can be telemetered to the surface or stored in a downhole memory for later retrieval.

The method involves drilling or re-entering a borehole and selecting an appropriate underground reservoir. The pressure, or some other characteristic of the fluid in the well borehole at the reservoir, the rock, or both, can then be measured. The extendable element, such as a packer or test probe, is set against the wall of the borehole to isolate a portion of the borehole or at least a portion of the borehole wall. In the non-rotatable sleeve embodiment, the drill string can continue rotating and advancing while the sleeve is held stationary during performance of the test.

If two packers are used, this will create an upper annulus, a lower annulus, and an intermediate annulus within the well borehole. The intermediate annulus corresponds to the isolated portion of the borehole, and it is positioned at the reservoir to be tested. Next, the pressure, or other property, within the intermediate annulus is measured. The well borehole fluid, primarily-drilling-mud, may then be withdrawn from the intermediate annulus with the pump. The level at which pressure within the intermediate annulus stabilizes may then be measured; it will correspond to the formation pressure. Pressure can also be applied to fracture the formation, or to perform a pressure test of the formation. Additional extendable elements may also be provided, to isolate two or more permeable zones. This allows the pumping of fluid from one or more zones to one or more other zones.

Alternatively, a piston or other test probe can be extended from the test apparatus to contact the borehole wall in a sealing relationship, or some other expandable element can be extended to create a zone from which essentially pristine formation fluid can be withdrawn. Further, the extendable probe can be used to position a sensor directly against the borehole wall, for analysis of the formation, such as by spectroscopy. Extension of the probe could also be accomplished by extending a locating arm or stabilizer rib from one side of the test tool, to force the opposite side of the test tool to contact the borehole wall, thereby exposing a sample port to the formation fluid. Regardless of the apparatus used, the goal is to establish a zone of pristine formation fluid from which a fluid or core sample can be taken, or in which characteristics of the fluid can be measured. This can be accomplished by various embodiments. The example first mentioned above is to use inflatable packers to isolate a portion of the entire borehole, subsequently withdrawing drilling fluid from the isolated portion until it fills with formation fluid. The other examples given accomplish the goal by expanding an element against a spot on the borehole wall, thereby directly contacting the formation and excluding drilling fluid.

The apparatus should be constructed so as to be protected during performance of the primary operations for which the work string is intended, such as drilling, re-entry, or workover. If an extendable probe is used, it can retract within the tool, or it can be protected by adjacent stabilizers, or both. A packer or other extendable elastomeric element can retract within a recess in the tool, or it can be protected by a sleeve or some other type of cover.

In addition to the pressure sensor mentioned above, the formation test apparatus can contain a resistivity sensor for measuring the resistivity of the well borehole fluid and the formation fluid, or other types of sensors. The resistivity of the drilling fluid is usually noticeably different from the resistivity of the formation fluid. If two packers are used, the resistivity of fluid being pumped from the intermediate annulus can be monitored to determine when all of the drilling fluid has been withdrawn from the intermediate annulus. As flow is induced from the isolated formation into the intermediate annulus, the resistivity of the fluid being pumped from the intermediate annulus is monitored. Once the resistivity of the exiting fluid differs sufficiently from the resistivity of the well borehole fluid, it is assumed that formation fluid has filled the intermediate annulus, and the flow is terminated. This can also be used to verify a proper seal of the packers, since leaking of drilling fluid past the packers would tend to maintain the resistivity at the level of the drilling fluid. Other types of sensors which can be incorporated are flow rate measuring devices, viscosity sensors, density measuring devices,- dielectric property measuring devices, and optical spectroscopes.

After shutting in the formation, the pressure in the intermediate annulus can be monitored. Pumping can also be resumed, to withdraw formation fluid from the intermediate annulus at a measured rate. Pumping of formation fluid and measurement of pressure can be sequenced -as desired to provide data which can be used to calculate various properties of the formation, such as permeability and size. If direct contact with the borehole wall is used, rather than isolating a section of the borehole, similar tests can be performed by incorporating test chambers within the test apparatus. The test chambers can be maintained at atmospheric pressure while the work string is being drilled or lowered into the borehole. Then, when the extendable element has been placed in contact with the formation, exposing a test port to the formation fluid, a test chamber can be selectively placed in fluid communication with the test port. Since the formation fluid will be at much higher pressure than atmospheric, the formation fluid will flow into the test chamber. In this way, several test chambers can be used to perform different pressure tests or take fluid samples.

In some embodiments which use expandable packers, the formation test apparatus has contained therein a drilling fluid return flow passageway for allowing return flow of the drilling fluid from the lower annulus to the upper annulus. Also included is at least one pump, which can be a Venturi pump or any other suitable type of pump, for preventing overpressurization in an intermediate annulus. Overpressurization can be undesirable because of the possible loss of the packer seal, or because it can hamper operation of extendable elements which may be operated by differential pressure between the inner bore of the work string and the annulus, or by a fluid pump. To prevent overpressurization, the drilling fluid is pumped down the longitudinal. inner bore of the work string, past the lower end of the work string (which is generally the bit), and up the annulus. Then the fluid is channeled through return flow passageway and the Venturi pump, creating a low pressure zone at the Venturi, so that the fluid within the intermediate annulus is held at a lower pressure than the fluid in the return flow passageway.

The device may also include a circulation valve, for opening and closing the inner bore of the work string. A shunt valve can be located in the work string and operatively associated with the circulation valve, for allowing flow from the inner bore of the work string to the annulus around the work string, when the circulation valve is closed. These valves can be used in operating the test apparatus as a down hole blow-out preventor.

In most embodiments, one or more gripper elements may be incorporated on the work string or non-rotating sleeve. The grippers are extendable and are used to engage the borehole well. Once the borehole wall is engaged, the grippers anchor the work string or non-rotating sleeve such that the work string or non-rotating sleeve remains substantially motionless during a test. The advantage of anchoring the tool is increased useful life of soft components such as pad members and packers.

In the case where an influx of reservoir fluids invade the borehole, which is sometimes referred to as a "kick", the method includes the steps of setting the expandable packers, and then positioning the circulating valve in the closed position. The packers are set at a position that is above the influx zone so that the influx zone is isolated. Next, the shunt valve is placed in the open position. Additives can then be added to the drilling fluid, thereby increasing the density of the mud. The heavier mud is circulated down the work string, through the shunt valve, to fill the annulus. Once the circulation of the denser drilling fluid is completed, the packers can be unseated and the circulation valve can be opened. Drilling may then resume.

An advantage of the present invention includes use of the pressure and resistivity sensors with the MWD system, to allow for real time data transmission of those measurements. Another advantage is that the present invention allows obtaining static pressures, pressure build-ups, and pressure draw-downs with the work string, such as a drill string, in place. Computation of permeability and other reservoir parameters based on the pressure measurements can be accomplished without pulling the drill string.

The packers can be set multiple times, so that testing of several zones is possible. By making-measurement of the down hole conditions possible -in real time, optimum drilling fluid conditions can be determined which will aid in hole cleaning, drilling safety, and drilling speed. When an influx of reservoir fluid and gas enter the well borehole, the high pressure is contained within the lower part of the well borehole, significantly reducing risk of being exposed to these pressures at surface. Also, by shutting-in the well borehole immediately above the critical zone, the volume of the influx into the well borehole is significantly reduced.

The novel features of this invention, as well as the invention itself, will be best understood from the attached drawings, taken along with the following description in which similar reference characters refer to similar parts, and in which:

BRIEF DESCRIPTION OF THE DRAWINGS

For a detailed understanding of the present invention, references should be made to the following detailed description of the preferred embodiment, taken in conjunction with the accompanying drawings, in which like elements have been given like numerals and wherein.

DESCRIPTION OF THE PREFERRED EMBODIMENTS

Figure 1:
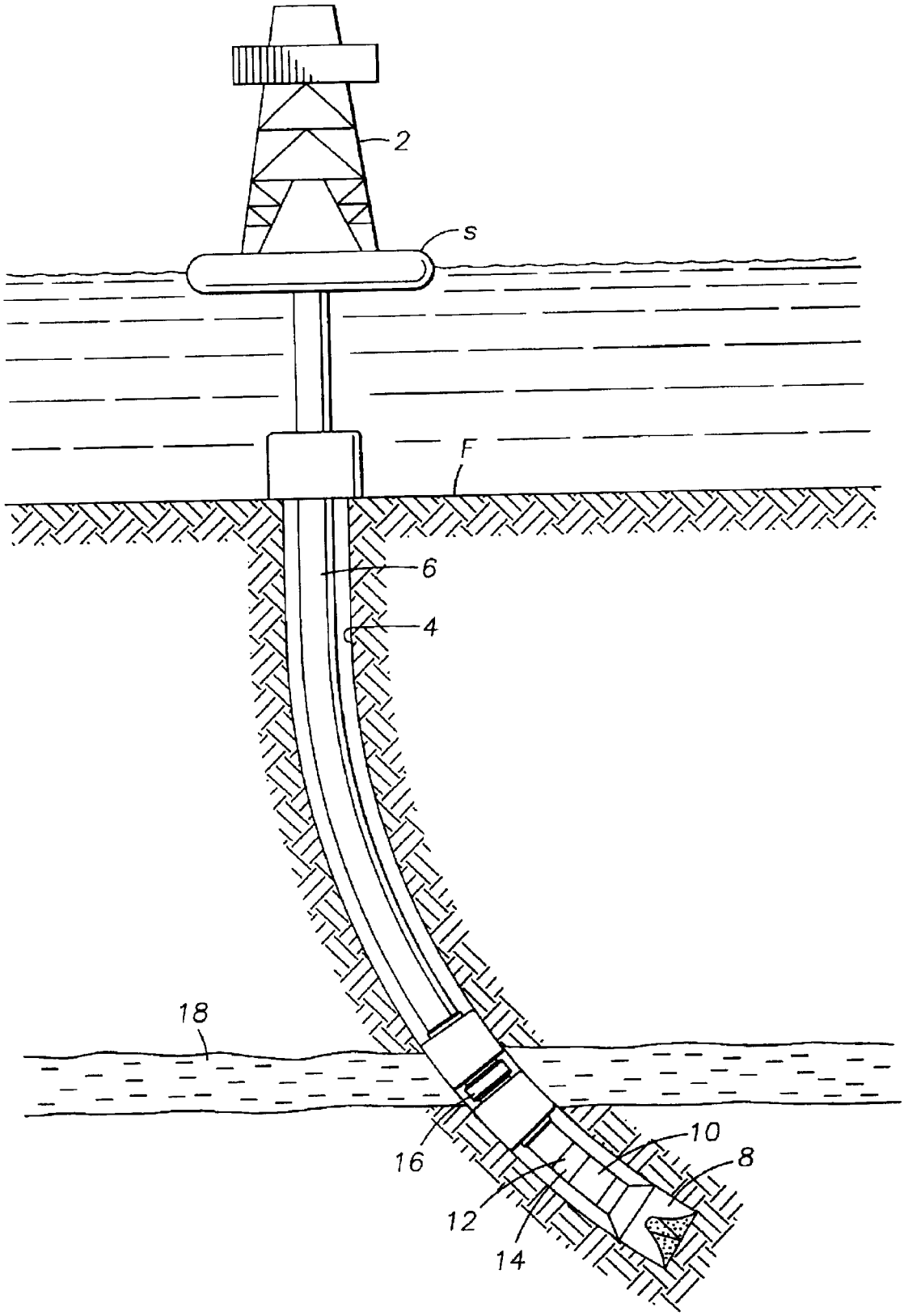
FIG. 1 is a partial section view of the apparatus of the present invention as it would be used with a floating drilling rig.

Referring to FIG. 1, a typical drilling rig 2 with a well borehole 4 extending therefrom is illustrated, as is well understood by those of ordinary skill in the art. The drilling rig 2 has a work string 6, which in the embodiment shown is a drill string. The work string 6 has attached thereto a drill bit 8 for drilling the well borehole 4. The present invention is also useful in other types of work strings, and it is useful with jointed tubing as well as coiled tubing or other small diameter work string such as snubbing pipe. FIG. 1 depicts the drilling rig 2 positioned on a drill ship S with a riser extending from the drilling ship S to the sea floor F.

If applicable, the work string 6 can have a downhole drill motor 10. Incorporated in the drill string 6 above the drill bit 8 is a mud pulse telemetry system 12, which can incorporate at least one sensor 14, such as a nuclear logging instrument. The sensors 14 sense down hole characteristics of the well borehole, the bit, and the reservoir, with such sensors being well known in the art. The bottom hole assembly also contains the formation test apparatus 16 of the present invention, which will be described in greater detail hereinafter. As can be seen, one or more subterranean reservoirs 18 are intersected by the well borehole 4.

Figure 2:
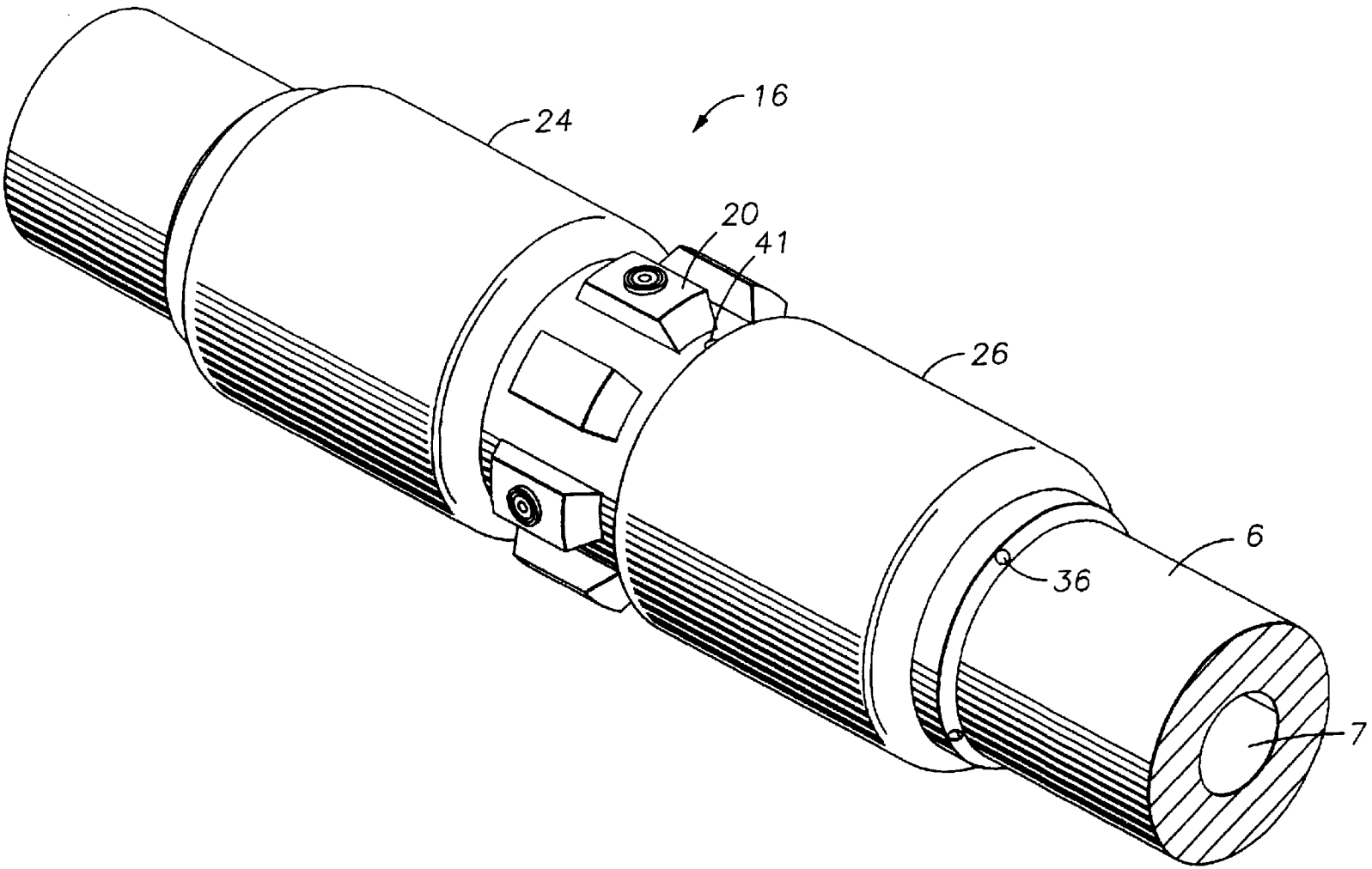
FIG. 2 is a perspective view of one embodiment of the present invention, incorporating expandable packers.

FIG. 2 shows one embodiment of the formation test apparatus 16 in a perspective view, with the expandable packers 24, 26 withdrawn into recesses in the body of the tool. Stabilizer ribs 20 are also shown between the packers 24, 26, arranged around the circumference of the tool, and extending radially outwardly. Also shown are the inlet ports to several drilling fluid return flow passageways 36 and a draw down passageway 41 to be described in more detail below.

Figure 3:
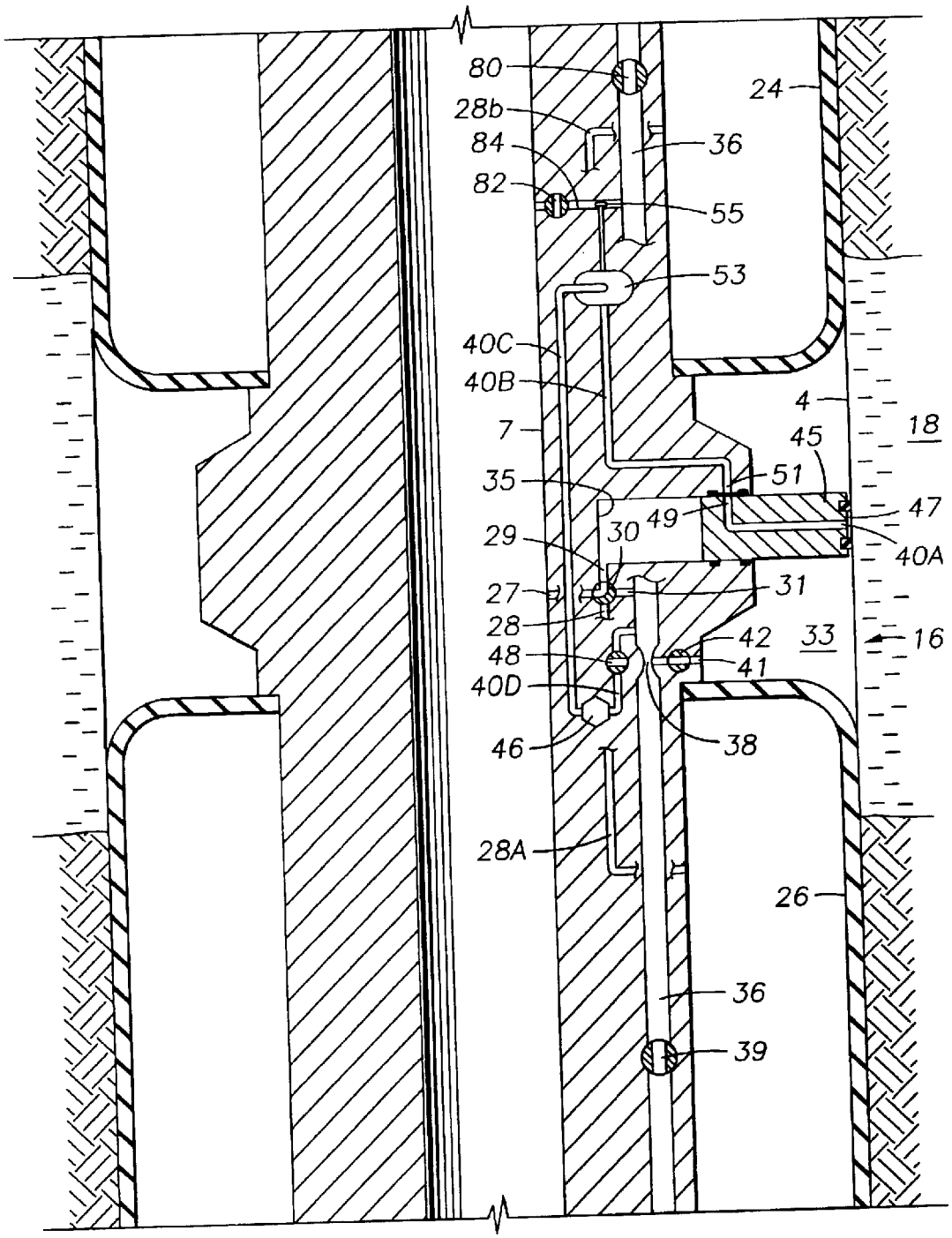
FIG. 3 is a section view of the embodiment of the present invention shown in FIG. 2.

Referring now to FIG. 3, one embodiment of the formation test apparatus 16 is shown positioned adjacent the reservoir 18. The test apparatus 16 contains an upper expandable packer 24 and a lower expandable packer 26 for sealingly engaging the wall of the well borehole 4. The packers 24, 26 can be expanded by any method known in the art. Inflatable packers are well known in the art, with inflation being accomplished by injecting a pressurized fluid into the packer. Optional covers for the expandable packer elements may also be included to shield the packer elements from the damaging effects of rotation in the well borehole, collision with the wall of the well borehole, and other forces encountered during drilling, or other work performed by the work string.

A high pressure drilling fluid passageway 27 is formed between the longitudinal internal bore 7 and an expansion element control valve 30. An inflation fluid passageway 28 conducts fluid from a first port of the control valve 30 to the packers 24, 26. The inflation fluid passageway 28 branches off into a first branch 28A that is connected to the inflatable packer 26 and a second branch 28B that is connected to the inflatable packer 24. A second port of the control valve 30 is connected to a drive fluid passageway 29, which leads to a cylinder 35 formed within the body of the test tool 16. A third port of the control valve 30 is connected to a low pressure passageway 31, which leads to one of the return flow passageways 36. Alternatively, the low pressure passageway 31 could lead to a Venturi pump 38 or to a centrifugal pump 53 which will be discussed further below. The control valve 30 and the other control elements to be discussed are operable by a downhole electronic control system 100 seen in FIG. 8, which will be discussed in greater detail hereinafter.

It can be seen that the control valve 30 can be selectively positioned to pressurize the cylinder 35 or the packers 24, 26 with high pressure drilling fluid flowing in the longitudinal bore 7. This can cause the piston 45 or the packers 24, 26 to extend into contact with the wall of the borehole 4. Once this extension has been achieved, repositioning the control valve 30 can lock the extended element in place. It can also be seen that the control valve 30 can be selectively positioned to place the cylinder 35 or the packers 24, 26 in fluid communication with a passageway of lower pressure, such as the return flow passageway 36. When spring returns are utilized in the cylinder 35 or the packers 24, 26, as is well known in the art, the piston 45 will retract into the cylinder 35, and the packers 24, 26 will retract within their respective recesses. Alternatively, as will be explained below in the discussion of FIG. 7, the low pressure passageway 31 can be connected to a suction device, such as a pump, to draw the piston 45 within the cylinder 35, or to draw the packers 24, 26 into their recesses.

Once the inflatable packers 24, 26 have been inflated, an upper annulus 32, an intermediate annulus 33, and a lower annulus 34 are formed. This can be more clearly seen in FIG. 5. The inflated packers 24, 26 isolate a portion of the well borehole 4 adjacent the reservoir 18 which is to be tested. Once the packers 24, 26 are set against the wall of the well borehole 4, an accurate volume within the intermediate annulus 33 may be calculated, which is useful in pressure testing techniques.

The test apparatus 16 also contains at least one fluid sensor system 46 for sensing properties of the various fluids to be encountered. The sensor system 46 can include a resistivity sensor for determining the resistivity of the fluid. Also, a dielectric sensor for sensing the dielectric properties of the fluid, and a pressure sensor for sensing the fluid pressure may be included. Other types of sensors which can be incorporated are flow rate measuring devices, viscosity sensors, density measuring devices, a nuclear magnetic resonance sensor, and optical spectroscopes. A series of passageways 40A, 40B, 40C, and 40D are also provided for accomplishing various objectives, such as drawing a pristine formation fluid sample through the piston 45, conducting the fluid to a sensor 46, and returning the fluid to the return flow passageway 36. A sample fluid passageway 40A passes through the piston 45 from its outer face 47 to a side port 49. A sealing element 47A can be provided on the outer face 47 of the piston 45 to ensure that the sample obtained is pristine formation fluid. This in effect isolates a portion of the well borehole from the drilling fluid or any other contaminants or pressure sources.

Alternatively, the outer face 47 of the piston 45 can constitute or incorporate a formation evaluation sensor, for analysis of the formation itself, such as by spectroscopy. The sensor could also be in the pad.

When the piston 45 is extended from the tool, the piston side port 49 can align with a side port 51 in the cylinder 35. A pump inlet passageway 40B connects the cylinder side port 51 to the inlet of a pump 53. The pump 53 can be a centrifugal pump driven by a turbine wheel 55 or by another suitable drive device. The turbine wheel 55 can be driven by flow through a bypass passageway 84 between the longitudinal bore 7 and the return flow passageway 36. Alternatively, the pump 53 and other devices in this tool can be any other type of suitable power source. Some examples for power generation alternatives include a turbine driven alternator, a turbine driven hydraulic pump, a positive displacement motor driving a hydraulic pump, and rotation of the drill string relative to the non-rotating sleeve to drive an alternator or a hydraulic pump. Obviously, combinations of these power sources could also be used. A pump outlet passageway 40C is connected between the outlet of the pump 53 and the sensor system 46. A sample fluid return passageway 40D is connected between the sensor 46 and the return flow passageway 36. The passageway 40D has therein a valve 48 for opening and closing the passageway 40D.

Figure 4:
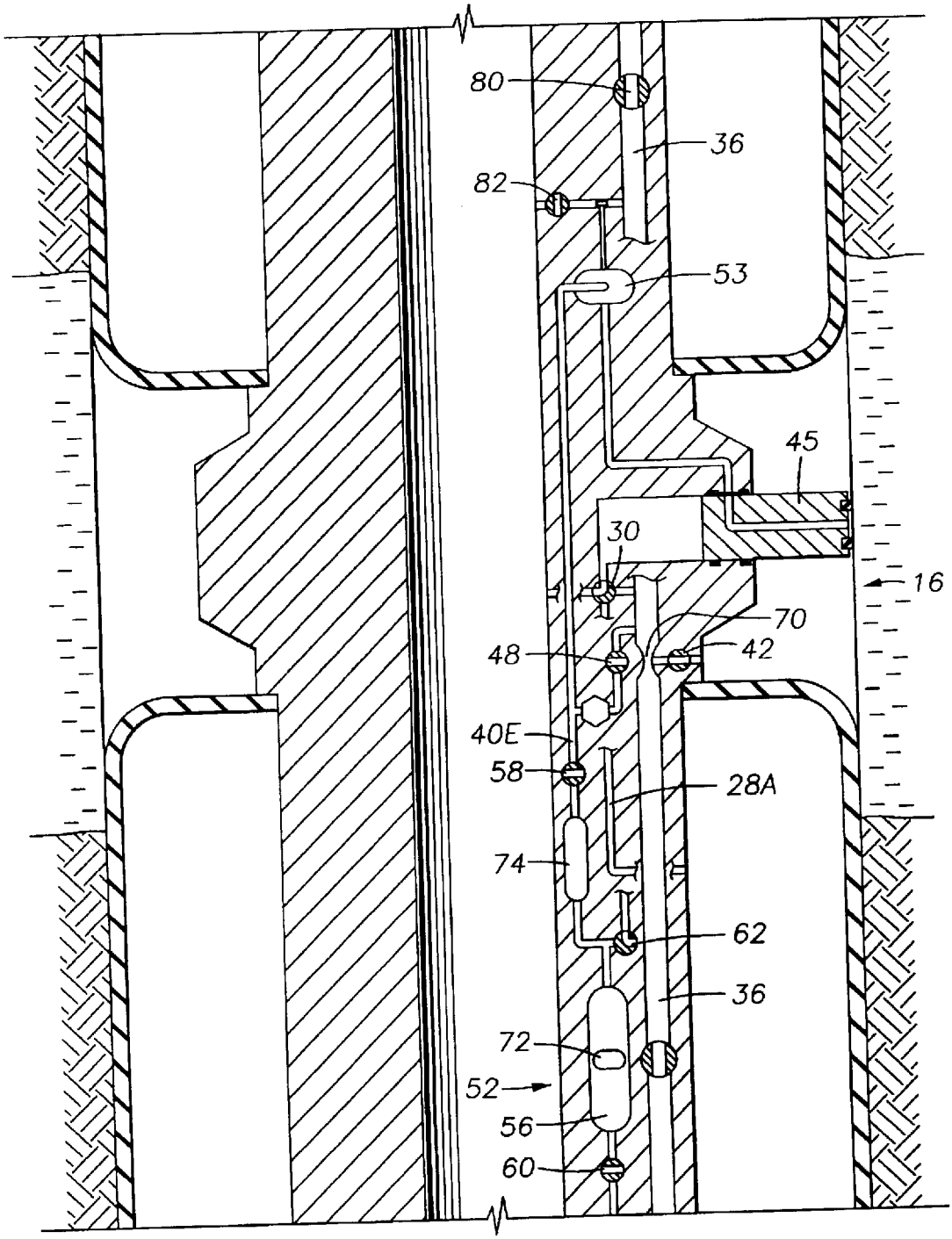
FIG. 4 is a section view of the embodiment shown in FIG. 3, with the addition of a sample chamber.

As seen in FIG. 4, there can be a sample collection passageway 40E which connects the passageways 40A, 40B, 40C, and 40D with the lower sample module, seen generally at 52. The passageway 40E leads to the adjustable choke 74 and to the sample chamber 56, for collecting a sample. The sample collection passageway 40E has therein a chamber inlet valve 58 for opening and closing the entry into the sample chamber 56. The sample chamber 56 can have a movable baffle 72 for separating the sample fluid from a compressible fluid such as air, to facilitate drawing the sample as will be discussed below. An outlet passage from the sample chamber 56 is also provided, with a chamber outlet valve 62 therein, which can be a manual valve. Also, there is provided a sample expulsion valve 60, which can be a manual valve. The passageways from valves 60 and 62 are connected to external ports (not shown) on the tool. The valves 62 and 60 allow for the removal of the sample fluid once the work string 6 has been pulled from the well borehole, as will be discussed below. Alternatively, the sample chamber 56 can be made wireline retrievable, by methods well known in the art.

When the packers 24, 26 are inflated, they will seal against the wall of the well borehole 4, and as they continue to expand to a firm set, the packers 24, 26 will expand slightly into the intermediate annulus 33. If fluid is trapped within the intermediate annulus 33, this expansion can tend to increase the pressure in the intermediate annulus 33 to a level above the pressure in the lower annulus 34 and the upper annulus 32. For operation of extendable elements such as the piston 45, it is desired to have the pressure in the longitudinal bore 7 of the drill string 6 higher than the pressure in the intermediate annulus 33. Therefore, a Venturi pump 38 is used to prevent overpressurization of the intermediate annulus 33.

The drill string 6 contains several drilling fluid return flow passageways 36 for allowing return flow of the drilling fluid from the lower annulus 34 to the upper annulus 32, when the packers 24, 26 are expanded. A Venturi pump 38 is provided within at least one of the return flow passageways 36, and its structure is designed for creating a zone of lower pressure, which can be used to prevent overpressurization in the intermediate annulus 33, via the draw down passageway 41 and the draw down control valve 42. Similarly, the Venturi pump 38 could be connected to the low pressure passageway 31, so that the low pressure zone created by the Venturi pump 38 could be used to withdraw the piston 45 or the packers 24, 26. Alternatively, as explained below in the discussion of FIG. 7, another type of pump could be used for this purpose.

Figure 5:
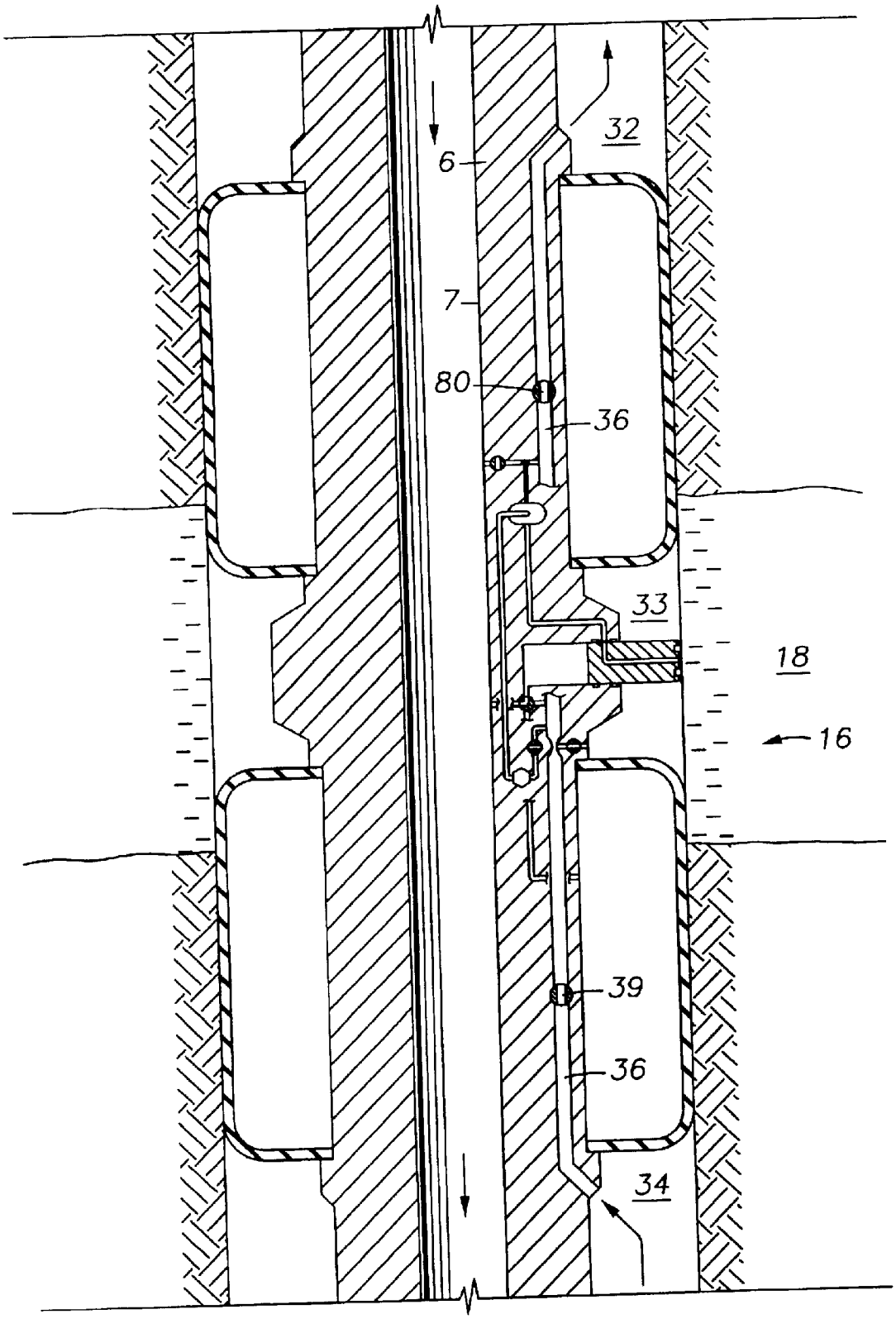
FIG. 5 is a section view of the embodiment shown in FIG. 3, illustrating the flow path of drilling fluid.

Several return flow passageways can be provided, as shown in FIG. 2. One return flow passageway 36 is used to operate the Venturi pump 38. As seen in FIG. 3 and FIG. 4, the return flow passageway 36 has a generally constant internal diameter until the Venturi restriction 70 is encountered. As shown in FIG. 5, the drilling fluid is pumped down the longitudinal bore 7 of the work string 6, to exit near the lower end of the drill string at the drill bit 8, and to return up the annular space as denoted by the flow arrows. Assuming that the inflatable packers 24, 26 have been set and a seal has been achieved against the well borehole 4, then the annular flow will be diverted through the return flow passageways 36. As the flow approaches the Venturi restriction 70, a pressure drop occurs such that the Venturi effect will cause a low pressure zone in the Venturi. This low pressure zone communicates with the intermediate annulus 33 through the draw down passageway 41, preventing any overpressurization of the intermediate annulus 33.

The return flow passageway 36 also contains an inlet valve 39 and an outlet valve 80, for opening and closing the return flow passageway 36, so that the upper annulus 32 can be isolated from the lower annulus 34. The bypass passageway 84 connects the longitudinal bore 7 of the work string 6 to the return flow passageway 36.

Figure 6:
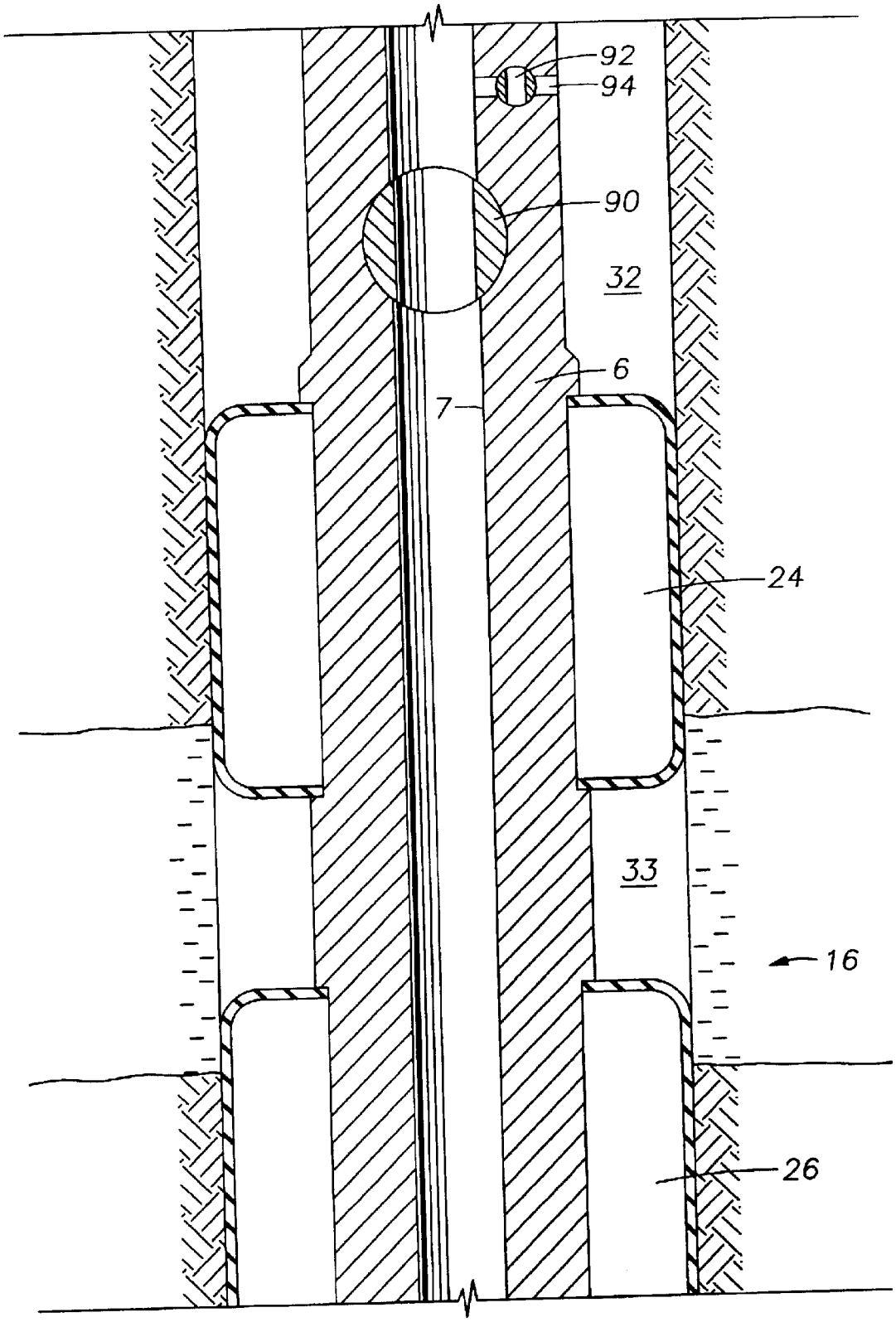
FIG. 6 is a section view of a circulation valve and a shunt valve which can be incorporated into the embodiment shown in FIG. 3.

Referring now to FIG. 6, yet another possible feature of the present invention is shown, wherein the work string 6 has installed therein a circulation valve 90, for opening and closing the inner bore 7 of the work string 6. Also included is a shunt valve 92, located in the shunt passageway 94, for allowing flow from the inner bore 7 of the work string 6 to the upper annulus 32. The remainder of the formation tester is the same as previously described.

The circulation valve 90 and the shunt valve 2 are operatively associated with the control system 100. In order to operate the circulation valve 90, a mud pulse signal is transmitted down hole, thereby signaling the control system 100 to shift the position of the valve 90. The same sequence would be necessary in order to operate the shunt valve 92.

Figure 7:
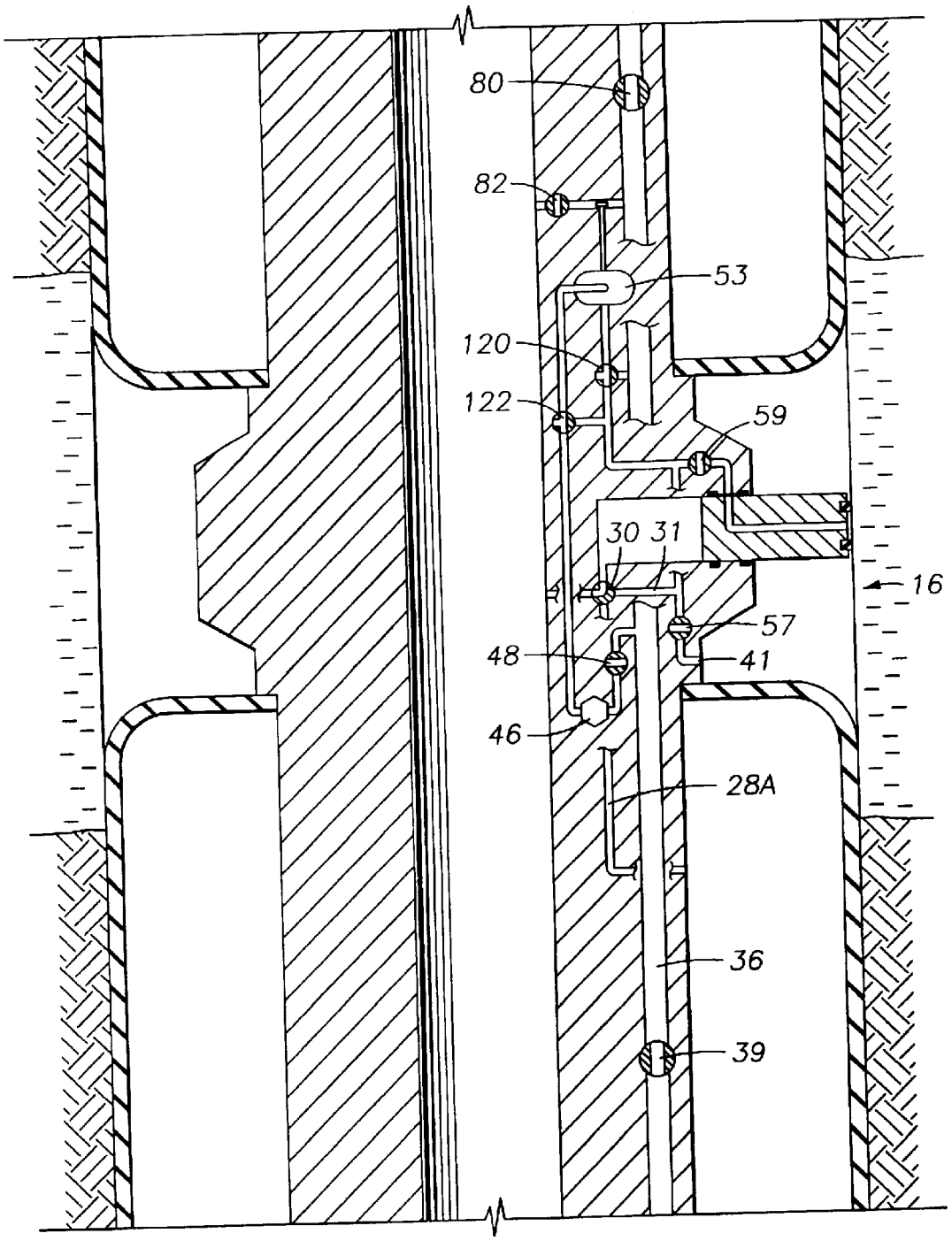
FIG. 7 is a section view of another embodiment of the present invention, showing the use of a centrifugal pump to drain the intermediate annulus.

FIG. 7 illustrates an alternative method of performing the functions performed by the Venturi pump 38. The centrifugal pump 53 can have its inlet connected to the draw down passageway 41 and to the low pressure passageway 31. A draw down valve 57 and a sample inlet valve 59 are provided in the pump inlet passageway to the intermediate annulus and the piston, respectively. The pump inlet passageway is also connected to the low pressure side of the control valve 30. This allows use of the pump 53, or another similar pump, to withdraw fluid from the intermediate annulus 33 through valve 57, to withdraw a sample of formation fluid directly from the formation through valve 59, or to pump down the cylinder 35 or the packers 24, 26.

FIG. 7 also shows a system for applying fluid pressure to the formation, either via the intermediate annulus 33 or via the sample inlet valve 59. The purpose of applying this fluid pressure may be either to fracture the formation, or to perform a pressure test of the formation. A pump inlet valve 120 and a pump outlet valve 122 are provided in the inlet and outlet, respectively, of the pump 53. The pump inlet valve 120 can be positioned as shown to align the pump inlet with the low pressure passageway 31 as required for the operations described above. Alternatively, the pump inlet valve 120 can be rotated clockwise a quarter turn by the control system 100 to align the pump inlet with the return -flow passageway 36. Similarly, the pump outlet valve 122 can be positioned as shown to align the pump outlet with the return flow passageway 36 as required for the operations described above. Alternatively, the pump outlet valve 122 can be rotated clockwise a quarter turn by the control system 100 to align the pump outlet with the low pressure passageway 31. With the pump inlet valve 120 aligned to connect the pump inlet with the return flow passageway 36 and the pump outlet valve 122 aligned to connect the pump outlet with the low pressure passageway 31, the pump 53 can be operated to draw fluid from the return flow passageway 36 to pressurize the formation via the low pressure passageway 31. Pressurization of the formation can be through the extendable piston 45, with the sample inlet valve 59 open and the draw down valve 57 shut. Alternatively, pressurization of the formation can be through the annulus 33, with the sample inlet valve 59 shut and the draw down valve 57 open.

Figure 8:
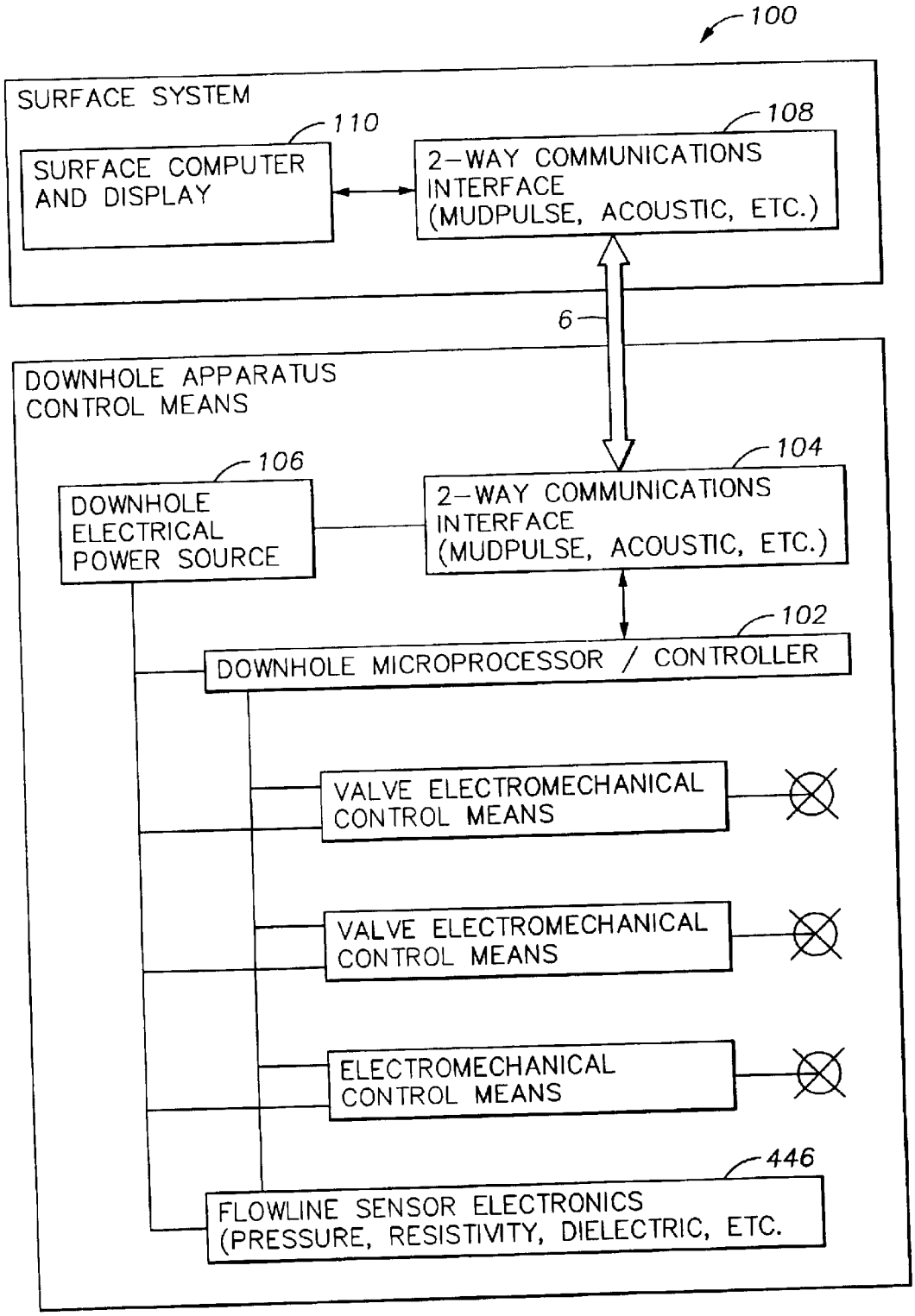
FIG. 8 is a schematic of the control system and the communication system which can be used in the present invention.

As depicted in FIG. 8, the invention includes use of a control system 100 for controlling the various valves and pumps, and for receiving the output of the sensor system 46. The control system 100 is capable of processing the sensor information with the downhole microprocessor/controller 102, and delivering the data to the communications interface 104, so that the processed data can then be telemetered to the surface using conventional technology. It should be noted that various forms of transmission energy could be used such as mud pulse, acoustical, optical, or electromagnetic. The communications interface 104 can be powered by a downhole electrical power source 106. The power source. 106 also powers the flow line sensor system 46, the microprocessor/controller 102, and the various valves and pumps.

Communication with the surface of the Earth can be effected via the work string 6 in the form of pressure pulses or other methods, as is well known in the art In the case of mud pulse generation, the pressure pulse will be received at the surface via the 2-way communication interface 108. The data thus received will be delivered to the surface computer 110 for interpretation and display.

Command signals may be sent down the fluid column by the communications interface 108, to be received by the downhole communications interface 104. The signals so received are delivered to the downhole microprocessor/controller 102. The controller 102 will then signal the appropriate valves and pumps for operation as desired.

A bi-directional communication system as known in the art can be used. The purpose of the two-way communication system, or bidirectional data link, would be both to receive data from the downhole tool and to be able to control the downhole tool from surface by sending messages or commands.

Data measured from the downhole tool, the MWD formation tester, needs to be transmitted to surface in order to utilize the measured data for real-time decisions and monitoring the drilling process. This can be data relating to measurements that are obtained from the subsurface formation, such as the formation pressure information about optical properties or resistivity of the fluid, annulus pressure, pressure build-up or draw-down data, etc. The tool also needs to be able to transmit to surface information that is used to control the tool during its operation. For instance, information about pressure inside the packers versus pressure in the annulus might be monitored to determine seal quality, information about fluid properties from the optical fluid analyzer or the resistivity sensor might be used to monitor when a sufficiently clean fluid is being produced from the formation, or status information pertaining to completion of operational steps might be monitored so that the surface operator, if required, can determine when to activate the next operational step. One example could be that a code is pulsed to surface when an operation is completed, for instance, activation of packer elements or extending a pad or other device to engage contact with the borehole wall. This data, or code, is then used by the operator to control the operation of the tool. Additionally, the downhole tool could transmit to surface information concerning the status of its health and information pertaining to the quality of the measurements.

In addition to being stored downhole, data may be transmitted from the, downhole tool to surface in several ways. Most commonly used are pressure pulses, in the mud system, either inside the drill pipe or up the outside annulus. Information may also be sent through the drill pipe itself, for instance, by the use of an acoustic signal, or if the drill pipe is connected with an electric, fiber optic or other type of, cable-or conductor, a signal can be sent through these. Also, the signal may be sent through the earth itself, as electromagnetic or acoustic waves. Regardless of the technique used, the purpose is to transmit information from the downhole tool to a receiving surface system that is capable of de-coding, presenting and storing this data.

The operation of the MWD formation tester technology may require that the tool be controlled from the surface. It may or may not be possible to program the tool to perform a sequence of operational steps that enables the tool to complete the measurement and testing process without surface intervention. Even if it is possible to program the tool for a complete sequence of events, it may be desirable to be able to interfere with the operation and, for instance, instruct the tool to start a new sequence of events, or to send commands to instruct the tool to discontinue its operation and revert to stand-by mode, for instance, if an emergency situation should occur. One system where data is sent both to and from a downhole tool is already in existence. On this system, the data is sent from surface to downhole by using a flow diverter on the surface to control the mud flow into the drill string. Variations in mud flow are picked up as signals by the downhole tool through measured variations in RPM of the power turbine of the downhole tool. Through a pre-set transmission code, the surface system can communicate with the downhole system. The system also includes sending a code from downhole to surface as a confirmation of having received a message from surface. Messages can be sent from surface to the downhole tool in many ways. Described above is a method of using variances in flow rate through the tool as a way of conveying information. It may also be possible to send information downhole using pressure pulses created at surface that travel through the drill pipe or the annulus and that are picked up by pressure sensor(s) in the downhole tool. Also, information can be sent down through an electric cable or a fibre optic cable, as will typically be the case when operating the formation tester on coiled tubing or through jointed drill pipe (using an acoustic signal), or through the earth (using an electromagnetic or acoustic signal). Regardless of the technique used, the purpose is to transmit information from surface to the downhole tool to be able to activate, re-program, control or in some way manipulate the downhole tool.

The down hole microprocessor/controller 102 can also contain a pre-programmed sequence of steps based on pre-determined criteria. Therefore, as the down hole data, such as pressure, resistivity, flow rate, viscosity, density, spectral analysis or other data from an optical sensor, or dielectric constants, are received, the microprocessor/controller would automatically send command signals via the controller to manipulate the various valves and pumps.

Figure 9:
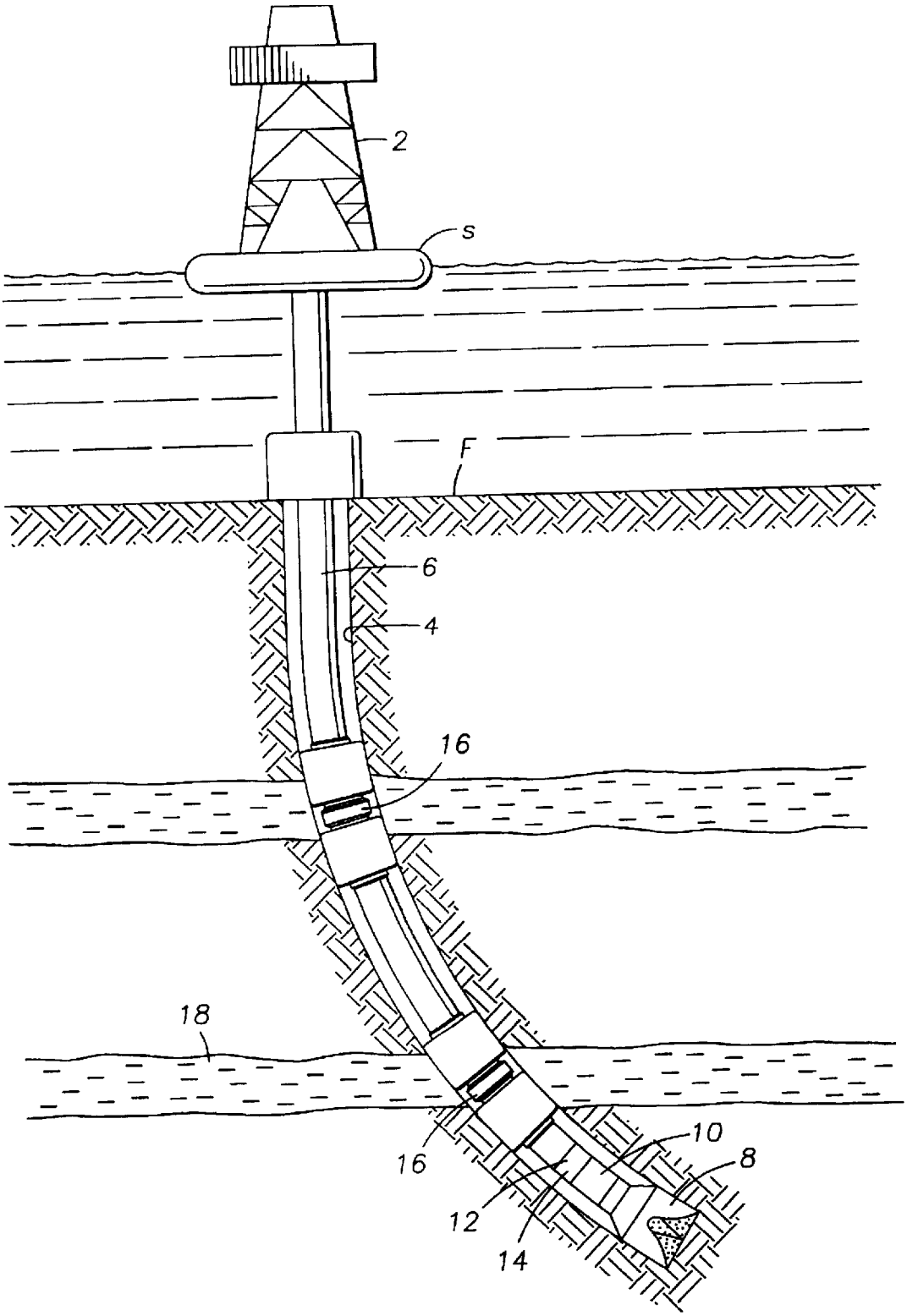
FIG. 9 is a partial section view of the apparatus of the present invention, showing more than two extendable elements.

As shown in FIG. 9, it can be useful to have two or more sets of extendable packers, with associated test apparatus 16 therebetween. One set of packers can isolate a first formation, while another set of packers can isolate a second formation. The apparatus can then be used to pump formation fluid from the first formation into the second formation. This function can be performed either from one annulus 33 at the first formation to another annulus 33 at the second formation, using the extended packers for isolation of the formations. Alternatively, this function can be performed via sample fluid passageways 40A in the two sets of test apparatus 16, using the extended pistons 45 for isolation of the formations. For instance, referring again to FIG. 7, in the first set of test apparatus 16, the sample inlet valve 59 can be closed and the draw down valve 57 opened. With the pump inlet and outlet valves 120, 122 aligned as shown in FIG. 7, the pump 53 can be operated to pump formation fluid from the annulus 33 at the first formation into the return flow passageway 36. The return flow passageway 36 can extend through the work string 6 to the second set of test apparatus 16 at the second formation. There, the second sample inlet valve 59 can be closed and the second draw down valve 57 can be opened, just as in the first set of test apparatus 16. However, in the second set of test apparatus 16, the pump inlet and outlet valves 120, 122 can be rotated clockwise a quarter turn to allow the second pump 53 to pump the first formation fluid from the return flow passageway 36 into the second formation via the second draw down valve 57 and via the annulus 33. Variations of this process can be used to pump formation fluid from one or more formations into one or more other formations. At the lower end of the work string 6, it may only be necessary to have a single extendable packer for isolating the lower annulus.

Figure 10:
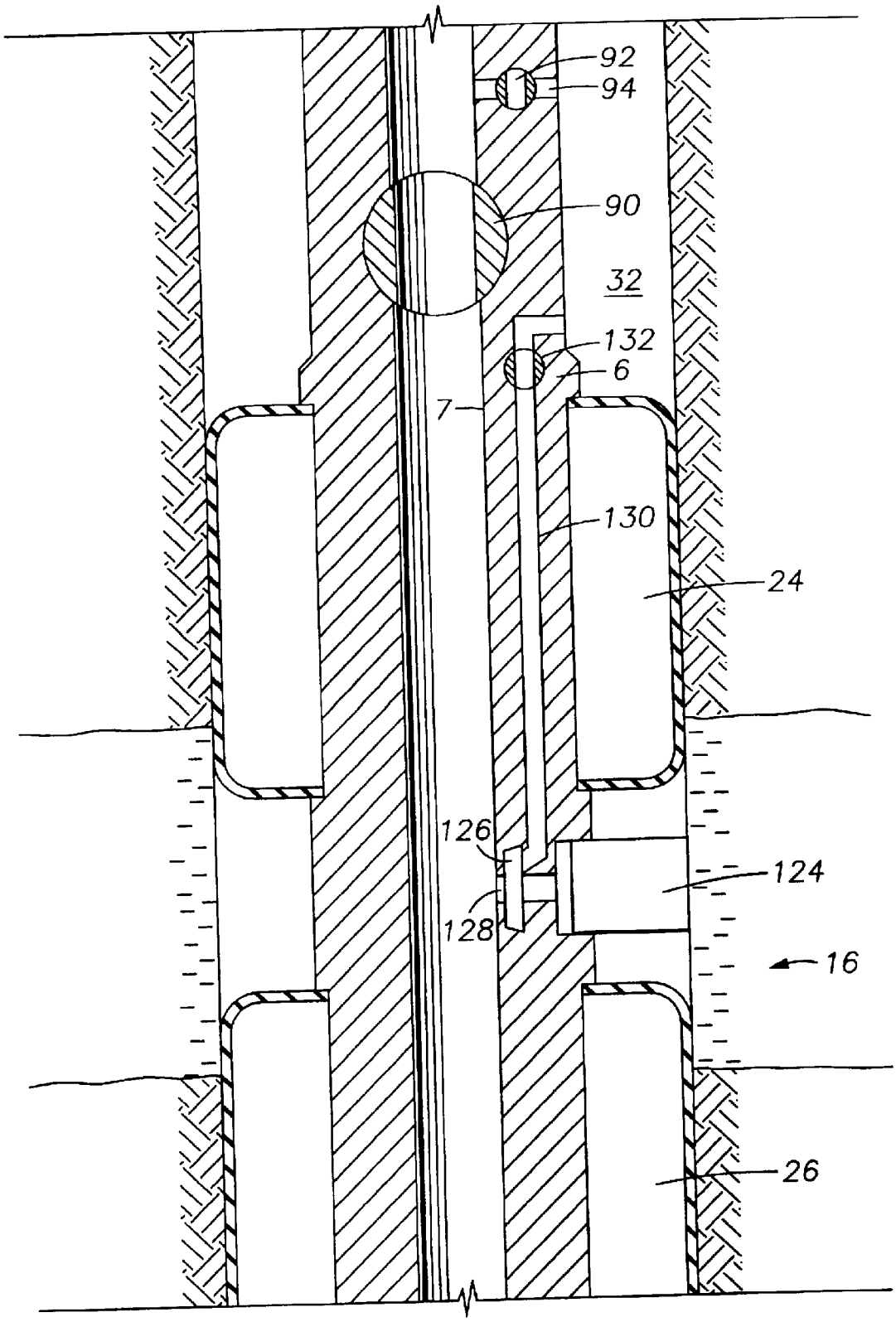
FIG. 10 is a section view of the apparatus of the present invention, showing one embodiment of a coring device.

As shown in FIG. 10, it can also be useful to incorporate a formation coring device 124 into the test apparatus 16 of the present invention. The coring device 124 can be extended into the formation by equipment identical to the equipment described above for extending the piston 45. The coring device 124 can be rotated by a turbine 126 which is activated by drilling fluid via the. central bore 7 and a turbine inlet port 128. The outlet of the turbine 126 can be via an outlet passageway 130 and a turbine control valve 132, which is controlled by the control system 100. With the packers 24, 26 extended, the coring device 124 is extended and rotated to obtain a pristine core sample of the formation. The core sample can then be withdrawn into the work string 6, where some chemical analysis can be performed if desired, and the core sample can be preserved in its pristine state, including pristine formation fluid, for extraction upon return of the test apparatus 16 to the surface.

Figure 11:
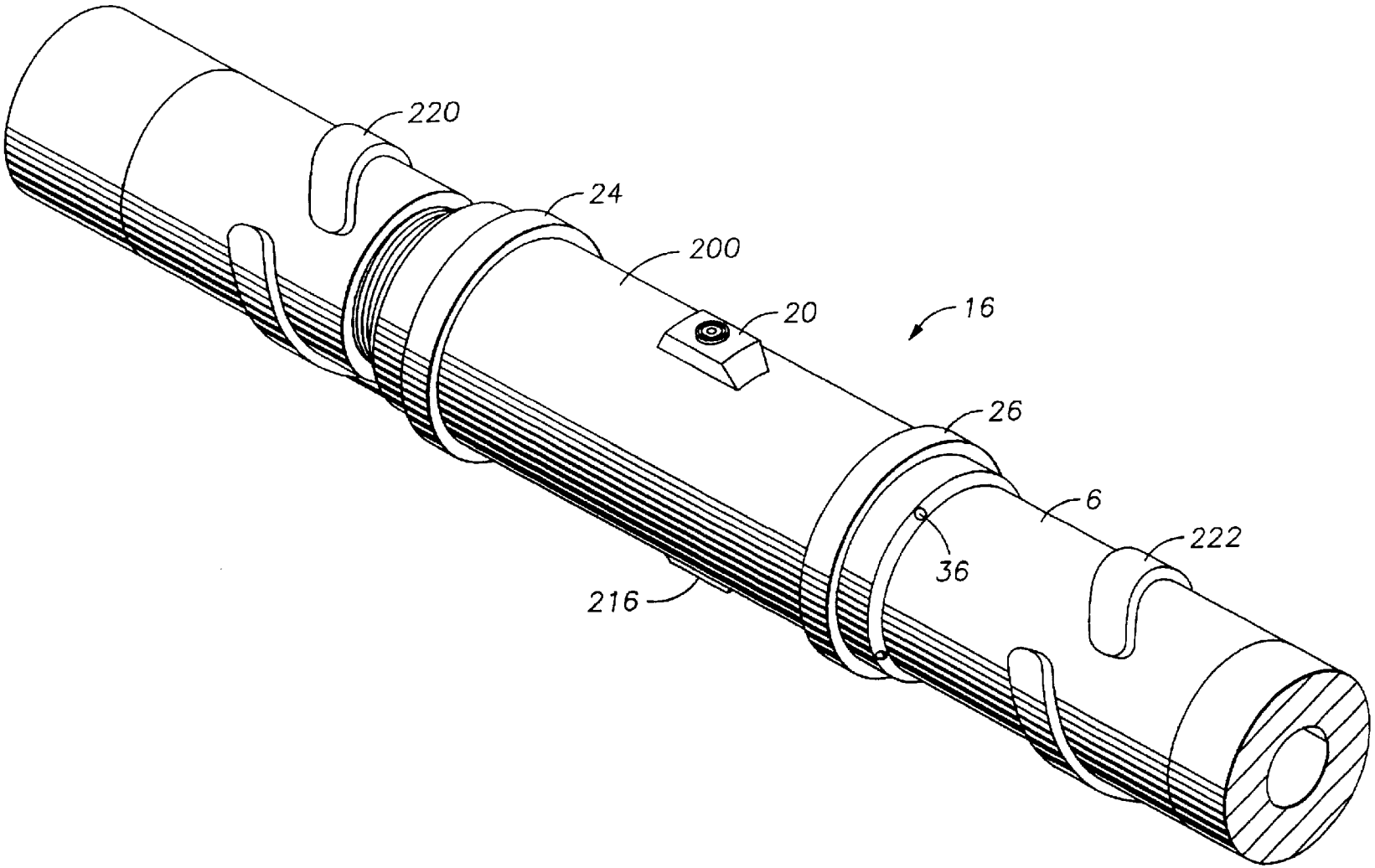
FIG. 11 is a perspective view of the apparatus of the present invention utilizing a non-rotating sleeve.

As shown in FIG. 11, the apparatus of the present invention can be modified by the use of a sliding, non-rotating, sleeve 200 to allow testing to take place while drilling or other rotation of the drill string continues. An extendable stabilizer blade 216 can be located on the side of the test tool opposite the test port, for the purpose of pushing the test port against the borehole wall, if no piston is used, or for centering of the test tool in the borehole. Upper stabilizers 220 and lower stabilizers 222 can be added on the work string 6 to separately stabilize the rotating portion of the work string.

Figure 12:
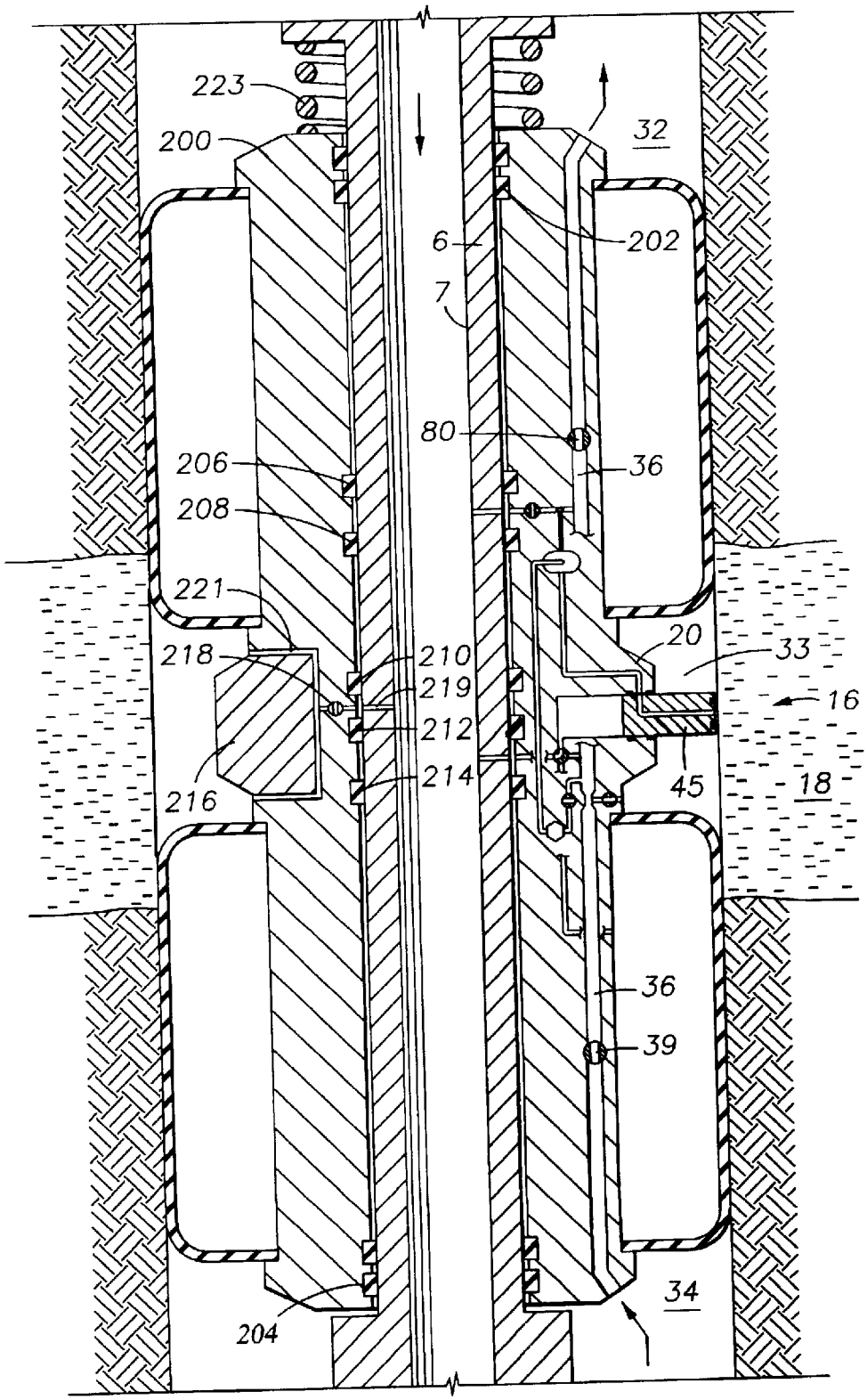
FIG. 12 is a section view of the embodiment shown in FIG. 11.

FIG. 12 is a longitudinal section view of the embodiment of the test apparatus 16 having a sliding, non-rotating, sleeve 200. The cylindrical non-rotating sleeve 200 is set into a recess in the outer surface of the work string 6. The space between the non-rotating sleeve 200 and the work string is sealed by upper rotating seals 202 and lower rotating seals 204. A plurality of other rotating seals 206, 208, 210, 212, 214 can be used to seal fluid passageways which lead from the inner bore 7 of the work string 6 to the test apparatus 16, depending upon the particular configuration of the test apparatus used. The non-rotating sleeve 200 is shorter than the recess into which it is set, to allow the work string 6 to move axially relative to the stationary sleeve 200, as the work string 6 advances during drilling. A spring 223 is provided between the upper end of the sleeve 200 and the upper end of the recess, to bias the sleeve 200 downwardly relative to the work string 6.

One or more extendable stabilizer blades or ribs 216 can be provided on the non-rotating sleeve 200, on the side opposite the test piston 45 or the test port rib 20. The test piston 45 can be used to obtain a fluid sample or to place a formation sensor directly against the formation. Sensors and other devices for formation testing can be placed either solely on the non-rotating sleeve 200 as shown in FIG. 12, or on the rotating portion of the work string 6 as shown in previous Figures, or in both locations. A remotely operated rib extension valve 218 can be provided in a passageway 219 leading from the work string bore 7 to an expansion chamber 221 in which the extendable rib 216 is located. Opening of the rib extension valve 218 introduces pressurized drilling fluid into the expansion chamber 221, thereby hydraulically forcing the extendable rib 216 to move outwardly to contact the borehole wall. Abutting shoulders or other limiting devices known in the art (not shown) can be provided on the extendable rib 216 and the non-rotating sleeve 200, to limit the travel of the extendable rib 216. Further, a spring or other biasing element known in the art (not shown) can be provided to return the extendable rib 216 to its stored -position upon release of the hydraulic pressure.

Figure 13:
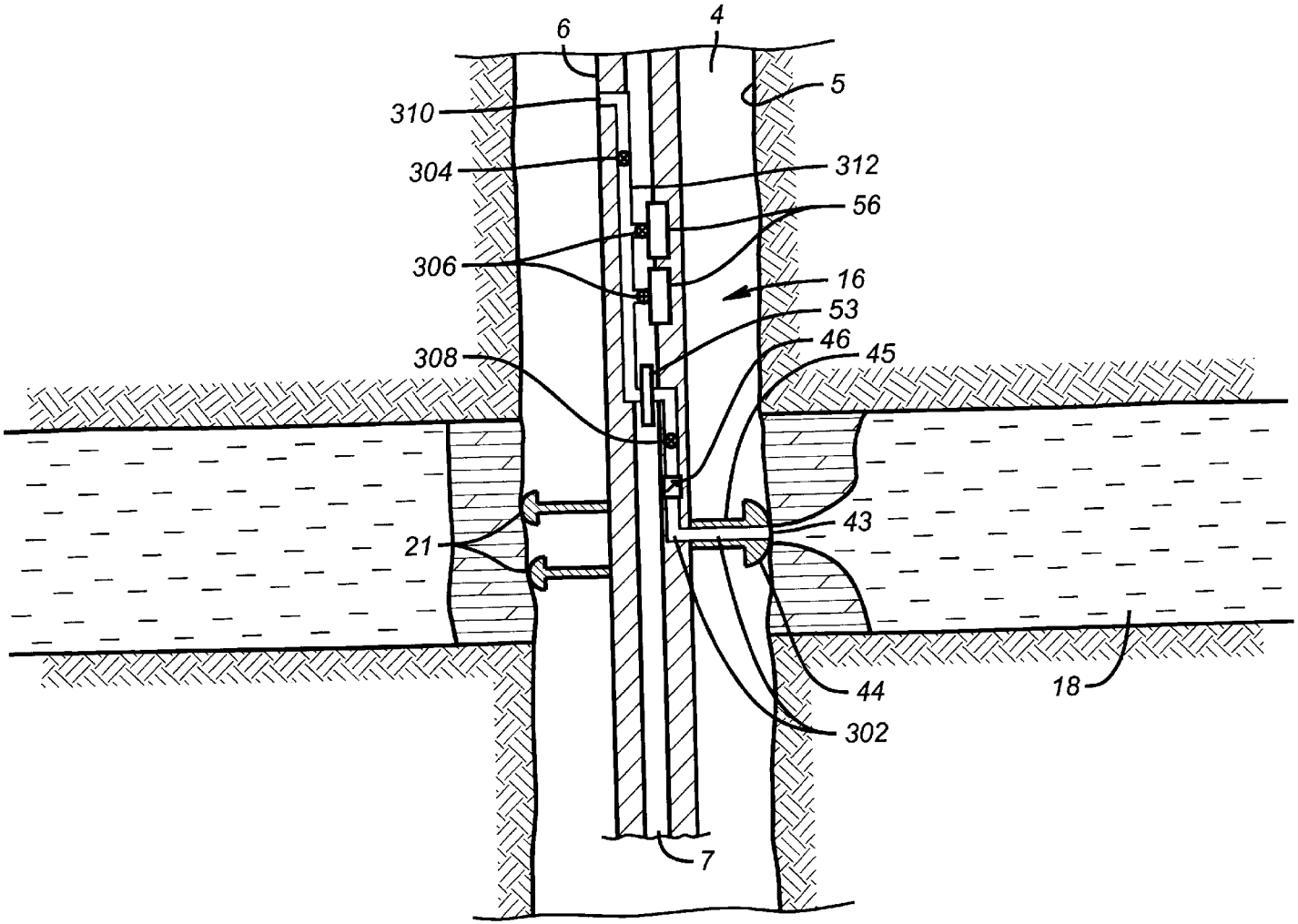
FIG. 13 is a schematic view of an embodiment of the present invention incorporating gripper elements.

FIG. 13 shows an embodiment according to the present invention wherein grippers are disposed opposite a probe. FIG. 13 is a schematic showing a drawdown test configuration wherein two extendable grippers 21 provide stabilization and counterforce for a well engaging pad element. A tool section 16 of a drill string 6 is disposed in a well borehole 4, and pressurized drilling fluid (mud) flows through a central bore 7 of the drill string 6 toward a drill bit (not shown) and returns to the surface via the annular space (annulus) between the drill string 6 and the borehole wall 5. A selectively extendable piston 45 disposed on the tool section 16 includes a sealing pad 44. The pad 44 is shown engaging the borehole wall 5 at a formation reservoir 18 containing formation fluid. Extendable grippers 21 disposed on the drill string 6 engage the borehole wall 5 generally opposite the point where the pad 44 engages the wall 5. The grippers 21 are used to anchor the tool section 16 and to provide a counterforce for ensuring a good seal between the pad 44 and wall 5. The mud may continue to flow in the annulus while the pad 44 and grippers 21 are extended, because the pad 44 only seals the annulus at a selected point against the wall 5. The mud is substantially free to flow around the grippers 21 and extendable piston 45.

A port 43 positioned at the interface between the pad 44 and wall 5 provides an intermediate annulus sealed from the rest of the annulus. A passageway 312 is connected to the port 43 to provide fluid communication between the reservoir 18 and the internal components housed in the tool section 16. A pump 53, which may be electromechanical or mud operated, is used to lower the pressure within the passageway 312 thereby allowing formation fluid from the reservoir 18 to enter the tool 16. A sensor such as a pressure gauge 46 is disposed in the passageway 312, and a valve 308 between the pressure gauge 46 and pump 53 is used to close a portion of the passageway 312 to become a system or test volume 302.

Optional sample collection chambers or tanks 56 are shown disposed in the drill string 6 and connected via sample valves 306 to the passageway 312 between a flush valve 304 and pump 53. An exit port 310 from the drill string 6 to the annulus is provided at the passageway 312 end. The flush valve 304 is disposed within the passageway 312 between the exit port 310 and pump 53. The valve port 304 may be opened during draw down or when the system volume 302 is flushed to the annulus.

When formation testing is desired, the pad 44 and grippers 21 are extended to engage the wall on opposite sides of the borehole 4. The pad 44 seals against the wall and separates an intermediate annulus 33 from the main annulus. At this point, the intermediate annulus 33 and passageway 312 will have some of the drilling mud. The test valve 308 and flush valve 304 are opened, and the pump 53, is activated to reduce the pressure in the passageway 312. The passageway 302 pressure is reduced to a point below the formation pressure for a formation pressure test. Formation fluid from the reservoir 18 enters the passageway 312 through the port 43, flows through the pump 53 and then out of the passageway 312 through the exit port 310 and into the main annulus. The test volume 302 should contain relatively clean fluid, i.e. formation fluid substantially. uncontaminated by drilling mud (pristine formation fluid), for most tests to yield useful results. To obtain clean formation fluid, pumping is continued until substantially all of the mud trapped in the passageway 312 and mud initially invaded into the formation is flushed and replaced with pristine formation fluid. When the passageway contains clean formation fluid, the test valve 308 and flush valve 310 are closed and pumping is ceased.

Figure 15:
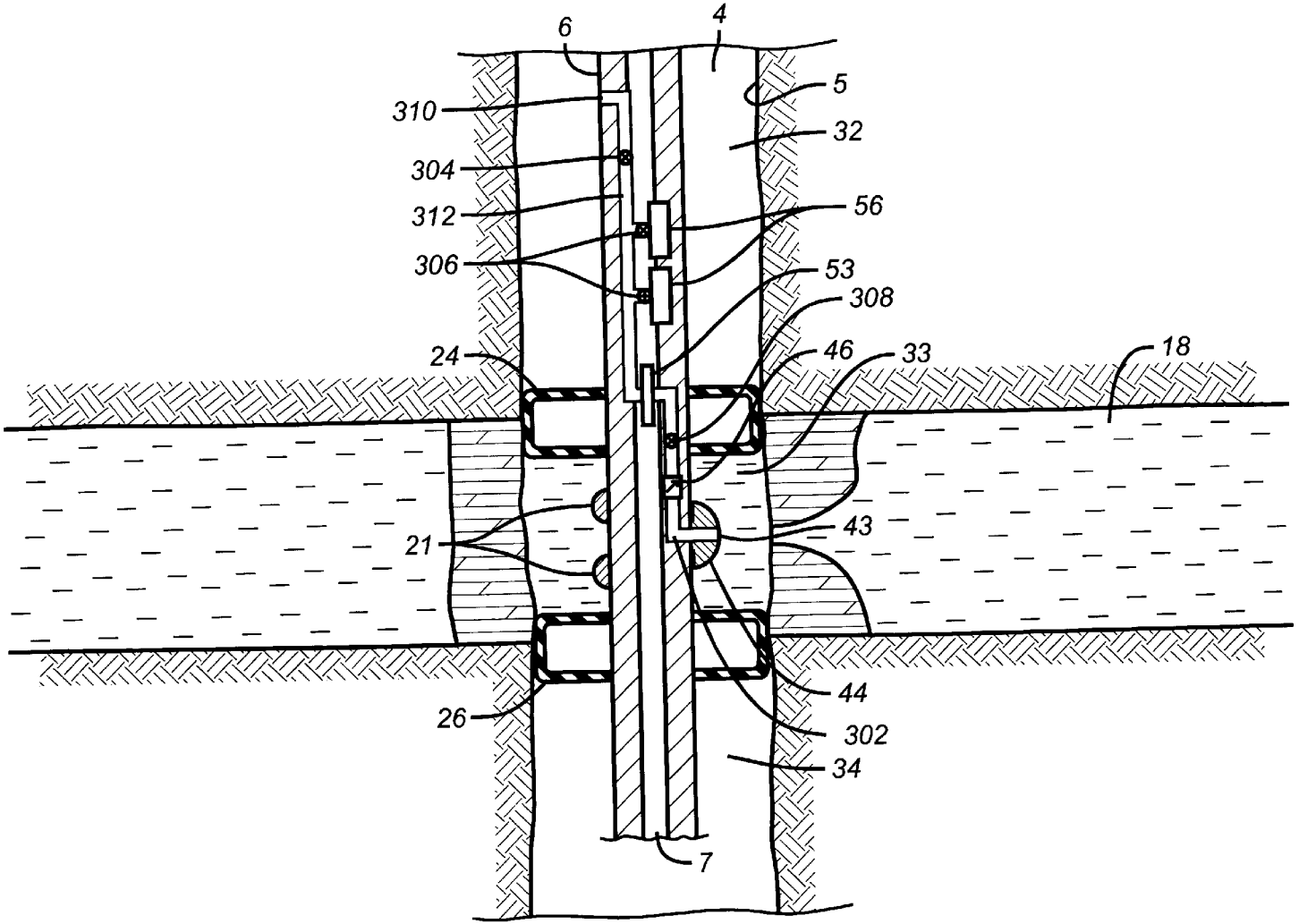
FIG. 15 is a schematic view of an embodiment of the present invention incorporating gripper elements and showing a mode of operation wherein the gripper elements and pad element are retracted during testing.

In an alternative embodiment as shown in FIG. 15, packers 24 and 26 could be used while the grippers 21 and pad 44 remain retracted. The packers separate the annulus into and upper annulus 32 above the upper packer 24, a lower annulus 34 downhole of the lower packer 26, and an intermediate annulus 33 between the upper and lower packers 24 and 26. The intermediate annulus 33 is created where a reservoir 18 is to be tested. In this embodiment, the test volume includes the intermediate annulus 33. All other aspects of the embodiment shown in FIG. 15 are as described with respect to the embodiment of FIG. 13.

Referring still to FIG. 13 for a formation pressure test, the pressure of test volume 302 is measured with the pressure sensor 46 during the draw down described above, and after the test valve 308 is closed. Formation fluid continues to enter the test volume 302 through the port 43 after the test valve 308 is closed, because the test volume pressure is below the formation pressure immediately after the test valve 308 is closed. The formation fluid entering the test volume 302 then causes the pressure within the test volume 302 to rise until the test volume pressure equals the formation pressure. The stabilized pressure is measured by the pressure gauge 46, and the results may be processed and stored downhole, processed and transmitted to the surface, or sent to the surface without preprocessing.

Prior to retracting the grippers 21 and pad 44, fluid samples may be taken by leaving the flush valve 304 closed and opening the test valve and one or more sample valves 306. The pump 53 can then be used to pump fluid into the sample tanks 56. After testing and sampling at a particular location are complete, the test valve and flush valve are opened, the grippers and pad are retracted and drilling is resumed. The test fluid may be pumped through the system to purge the passageway 312 in preparation for subsequent tests.

Figure 14:
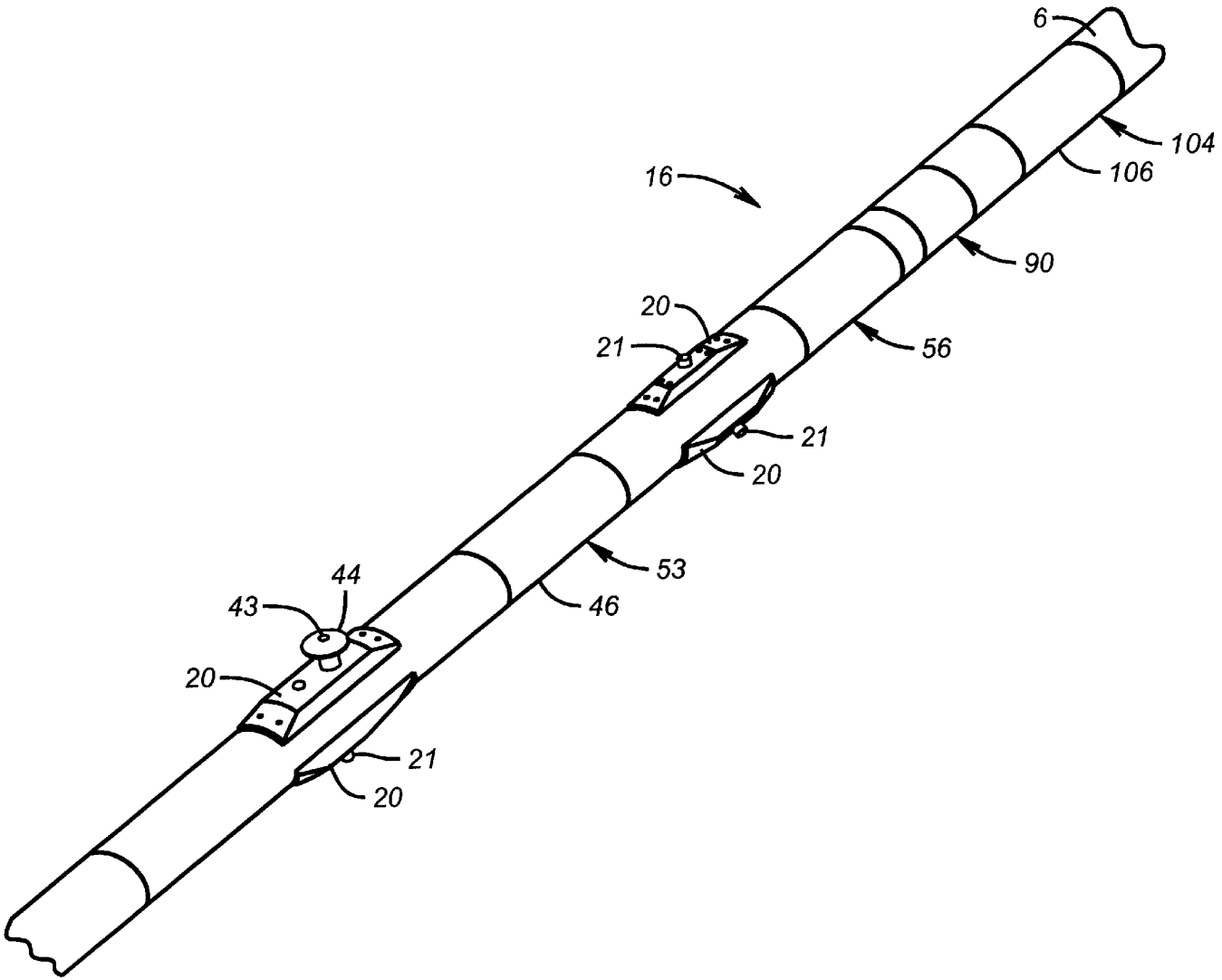
FIG. 14 is a perspective view of an embodiment of the present invention showing gripper elements integral to stabilizers and an extendible pad element integral to a stabilizer.

FIG. 14 shows a tool section 16 of a drill string 6 including a two-way communication system 104 and power supply 106 disposed at its upper end. The communication system 104 may be comprised of any well-known components suitable for the particular application. For example, the communication system 104 may be a mud pulse telemetry system, and acoustic or electromagnetic wave propagation system for MWD applications, or it may be an electronic digital or analog telemetry system in a wireline application. Likewise, the power supply 106 may be selected from any known system such as mud-driven turbine generator, battery or surface-source power. The power supply is chosen based on application needs. A circulation valve 90 is disposed on the tool section 16, and is typically disposed below the power supply 106 to allow continued circulation of mud to operate. This allows continued operation of the power supply 106 while drilling is stopped for sampling and testing of a formation. Shown disposed below the circulation valve 90 is an optional sample chamber section 56. Stabilizers 20 with integrated grippers 21 are mounted on the tool section 16 below the circulation valve 90 and sample chamber section 16. The grippers 21 are essentially identical to those described above for FIG. 13. The grippers 21 are selectively extendable and can engage the wall of a borehole to anchor the tool section 16. In the embodiment of FIG. 14, the grippers 21 are integrated into the stabilizers 20, which are also selectively extendable. The integrated combination allows the same extension mechanism to be used to extend the grippers 21 or stabilizers 20. This is useful in that sometimes it may be desired to stabilize the drill string 6 while continuing drilling. Thus the stabilizers are extended while the grippers 21 remain in a retracted position. When anchoring is desired, the stabilizers 20 are extended, and then the grippers 21 are extended from the already extended stabilizers 20. The lengths of the anchoring grippers 21 are minimized in this embodiment, which creates a stronger and more stable anchoring system.

A pump 53 and at least one measurement sensor 46 such as a pressure sensor are disposed in the tool section 16. The pump 53 and pressure sensor 46 may be the system shown in FIG. 13 and described above. A pad sealing element 44, operatively associated with the pump 53 and pressure sensor 46 is also disposed on the tool section 16. The pad sealing element 44 is selectively extendable by the use of a mud driven piston 45 or the like, and the pad 44 is shown integral to a stabilizer 20 to achieve the same advantages of compact design and strength as the grippers 21 and stabilizers 20 described above. The extended pad 44 engages a borehole wall to seal a portion of the wall. A port 43 located on the end of the pad 44 is in fluid communication with the pump 53 and measurement sensor 46. One or more grippers 21 and stabilizers 20 may be disposed about the circumference of the tool section 16 to provide an opposing force so the pad element 44 remains in sealing contact with the borehole wall during testing and sampling. Disposed downhole of the tool section 16 could be a typical BHA including a drill bit (not shown) well known in the art.

During drilling operations, drilling would be momentarily stopped for tasting of a formation. A command to open the circulation valve 90 may be issued from a surface location or from a not shown controller that may be disposed in the tool section 16. The circulation valve 90 then opens in response to the command to allow continued mud circulation through the drill string 6 and power supply 106. The stabilizers 20 and grippers 21 are then extended to engage the borehole wall to anchor the tool section. Once the tool section 16 is anchored in place, the stabilizer 20 and pad sealing element 44 are extended to seal a portion of borehole wall such that mud flowing in the annulus between the drill string 6 and borehole wall does not enter the port 43. The stabilizers 20 and grippers 21 located at the pad sealing element 44 are also extended to enhance the sealing of the pad by supplying a force on borehole wall generally opposite the pad 44.

Once the pad 44 is in sealing contact with the borehole wall, the pump 53 is activated to reduce the pressure at the port 43. Typically, mud trapped in the port should be expelled to the annulus to ensure only clean fluid in tested and sampled. A valve and exit (not shown) included on the tool section 16 may be used to expel any unwanted fluid from the system prior to testing. When the pressure is reduced at the port 43 formation fluid enters the port. If samples are desired, the fluid is directed by internal valves such as those shown in FIG. 13 to the storage tank section 56. Measurements of fluid characteristics, such as formation pressure, are taken with the sensor 46. The communication system 104 is then used to transmit data representative of the sensed characteristic to the surface. The data may also be preprocessed downhole by a processor (not shown) disposed in the tool section prior to transmitting the data to the surface.

Figure 16:
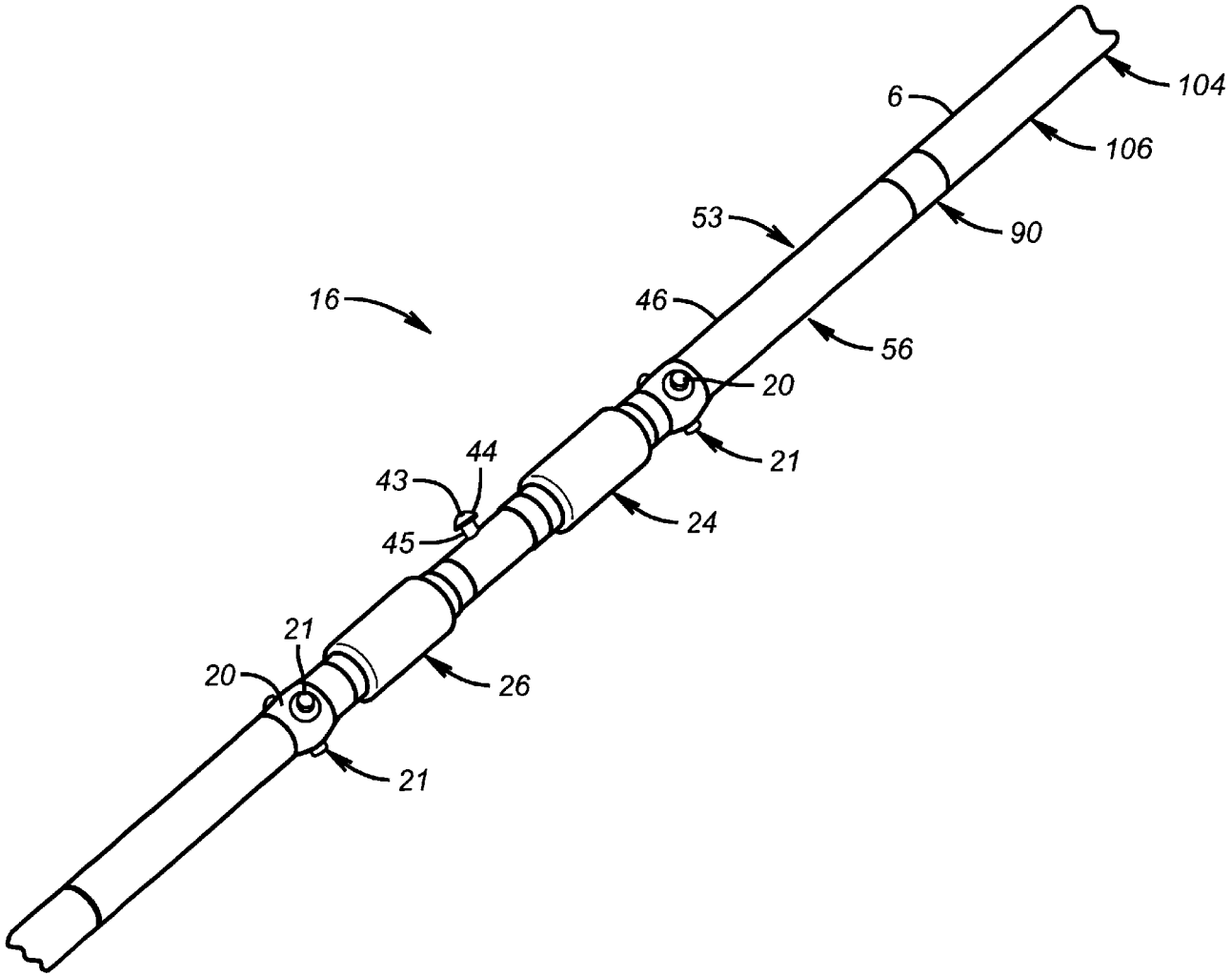
FIG. 16 is a perspective view of an embodiment of the present invention: that includes- integrated stabilizers and grippers, packers and an extendable pad element.

FIG. 16 shows another embodiment of a tool section 16 according to the present invention in a typical drill string 6. The tool section 16 has a two-way communication system 104 and power supply 106 disposed at its upper end. The communication system 105 may be comprised of any well-known components suitable for the particular application. For example, the communication system may be a mud pulse telemetry system for MWD applications, or it may be an electronic digital or analog telemetry system in a wireline application. Likewise, the power supply 106 may be selected from any known system such as mud-driven turbine generator, battery or surface-source power. The power supply is also chosen based on application needs. A circulation valve 90 is disposed on the tool section 16, and in systems using a mud turbine power supply is typically disposed below the power supply 106 to allow continued operation of the power supply 106 while drilling is stopped for sampling and testing of a formation. Shown disposed below the circulation valve 90 is an optional sample chamber section 56. Stabilizers 20 with integrated grippers 21 are mounted on the tool section 16 below the circulation valve 90 and sample chamber section 56. The grippers 21 are essentially identical to those described above for FIG. 13. The grippers 21 are selectively extendable and can engage a borehole to anchor the tool section 16. In the embodiment of FIG. 16, the grippers 21 are integrated into the stabilizers 20, which are also selectively extendable. The integrated combination allows the same extension mechanism to be used to extend the grippers 21 or stabilizers 20. This is useful, in that sometimes it may be desired to stabilize the drill string 6 while continuing drilling and at other times, it may be desirable to stop drilling and anchor the drill string 6. The stabilizers 20 are extended while the grippers 21 remain in a retracted position for stabilization during drilling. When anchoring is desired, the stabilizers 20 are extended, and then the grippers 21 are extended from the already extended stabilizers 20. The lengths of the anchoring grippers 21 are thus minimized creating a stronger and more stable anchoring system.

A pump 53 and at least one measurement sensor 46 such as a pressure sensor are disposed in the tool section 16. The pump 53 and pressure sensor 46 may be the system shown in FIG. 13 and described above. Upper and lower packers 24 and 26 are disposed on the tool section above and below a pad sealing element 44. The packers 24 and 26 may be mud-inflatable packers as described above and are used to seal a portion of annulus around the pad sealing element 44 from the rest of the annulus. The pad sealing element 44 is operatively associated with the pump 53 and pressure sensor 46 and is mounted on the tool section 16 between the upper and lower packers 24 and 26. The pad sealing element 44 is selectively extendable by the use of a mud driven piston 45 or the like. The extended pad sealing element 44 engages a borehole wall to seal a portion of the wall between the upper and lower packers 24 and 26. A port 43 located on the end of the pad sealing element 44 is in fluid communication with the pump 53 and measurement sensor 46. Another port (not shown separately) positioned on the tool section 16 between the packers 24 and 26 may be used in conjunction with the pump 53 to reduce the pressure between the packers. This is done by pumping the mud trapped between the packers 24 and 26 to the annulus above the upper packer 24. With pressure reduced between the packers below the pressure at the port 43, a pressure differential is created between the port 43 and the annulus between the packers 24 and 26, thereby ensuring that any leakage at the port is formation fluid leakage from the port into the annulus rather than mud from the annulus leaking into the port 43. Another set of stabilizers 20 and grippers 21 may be positioned downhole of the lower packer 26 to provide added tool stabilization and anchoring during tests. A typical BHA including a drill bit (not shown) well known in the art, would be disposed on the drill string 6 down hole of the depicted tool section 16.

There could be any number of variations to the above-described embodiments that do not require additional illustration. For example, alternate embodiments could be the embodiments of FIGS. 13–16 wherein the selectively extendable pad members 44 are multiple selectively extendable pad members. Also, any embodiment with integrated grippers 21 and stabilizers 20 may be altered wherein separate grippers and stabilizers are used, or wherein grippers are used without stabilizers.

Operation

In operation, the formation tester 16 is positioned adjacent a selected formation or reservoir. Next, a hydrostatic pressure is measured utilizing the pressure sensor located within the sensor system 46, as well as determining the drilling fluid resistivity at the formation. This is achieved by pumping fluid into the sample system 46, and then stopping to measure the pressure and resistivity. The data is processed down hole and then stored or transmitted up-hole using the MWD telemetry system.

Next, the operator expands and sets the inflatable packers 24, 26. This is done by maintaining the work string 6 stationary and circulating the drilling fluid down the inner bore 7, through the drill bit 8 and up the annulus. The valves 39 and 80 are open, and therefore, the return flow passageway 36 is open. The control valve 30 is positioned to align the high pressure passageway 27 with the inflation fluid passageways 28A, 28B, and drilling fluid is allowed to flow into the packers 24, 26. Because of the pressure drop from inside the inner bore 7 to the annulus across the drill bit 8, there is a significant pressure differential to expand the packers 24, 26 and provide a good seal. The higher the flow rate of the drilling fluid, the higher the pressure drop, and the higher the expansion force applied to the packers 24, 26. In the non-rotating sleeve embodiment, extension of the packers 24, 26 can be used to stop and prevent rotation of the test apparatus 16. When the packers 24, 26 are retracted, the sleeve 200 rests on the lower end of the recess in the work string 6. The packers 24, 26 are activated by a hydraulic system controlled by the downhole electronics. As the work string 6 advances during drilling, the sleeve 200 remains stationary relative to the borehole, compressing the spring 223. Thus, the sleeve 200 is essentially decoupled from the movement of the work string 6, enabling formation test measurements to be carried out, without being influenced by the movement of the work string 6. Therefore, there is no requirement to interrupt the drilling process.

One main application of the MWD formation tester is to collect one or several fluid samples downhole, store these and bring them to surface, either by retrieving them with a wireline or when the downhole tool is being brought to surface. The fluid samples will then be collected and one or more analyses or tests will be carried out on the fluid sample in order to determine various properties of the formation fluid. This again is helpful when performing various analyses or simulations in order, to predict the behavior of the reservoir and the reservoir fluid when this is being produced. Common analyses include so-called Pressure-Volume-Temperature analysis, or PVT analysis. A basic PVT analysis is required in order to relate surface production to underground withdrawal of hydrocarbons. Some basic parameters that are derived from a PVT analysis are determination of bubble point pressure or dew point pressure, gas-oil or gas-liquid ratio, oil formation factor and gas formation factor.

Principally, the PVT analysis can be performed by keeping one of the three parameters, P or V or T, constant, while observing the relationship of the two others. Most commonly, this is done by keeping the temperature constant at reservoir temperature, then using a positive displacement or other type of pump to make controlled changes to the sample volume, decreasing or increasing, and measuring the pressure accordingly. If this operation is carried out downhole, basic properties of the reservoir fluid may be provided without bringing the sample to surface. Other properties of interest, such as fluid density and fluid viscosity may also be measured downhole. Fluid viscosity may be determined by flowing the reservoir fluid through a tube or a flow channel, and measuring the pressure drop between two points in the tube. Alternatively, a rolling ball viscometer or other devices can be used. These tests are preferably carried out over the entire range of pressure steps from above bubble point to atmospheric pressure. Other key parameters to determine from the downhole sample are the fluid composition and gravity (density). In order to do so, downhole, it is necessary to identify the various elements of the fluid, through an optical fluid analyzer, a particle analyzer or a similar device. Such analyses usually give the mole fractions of each component up to the hexanes. The heptanes and heavier components of the reservoir fluid are grouped together and the average molecular weight and density of the latter is determined.

Some of the main drivers for performing PVT analysis of the fluid samples downhole would be safety benefits associated by not bringing a high pressure sample to surface, the ability to perform the all tests at in-situ conditions, and the benefit of being able to collect a new sample if the original sample is of questionable quality, to mention a few. Possibly, these analyses may be performed by the downhole tool after a sample has been collected and while drilling on to the next zone of interest. Therefore, the data may be available much sooner; some key parameters may even be communicated to surface while drilling or while the tool is still in hole. The data may then be used to optimize the drilling and the completion of the well. Alternatively, a basic PVT analysis is performed at the rig site or in a laboratory, hours or days after the sample was collected. Fluid composition, density and viscosity are nearly always analyzed in a laboratory.

Once the formation test is complete, the packers 24, 26 are retracted. The spring 223, or other biasing device known in the art, then pushes the sleeve 200 against the lower end of the recess in the work string 6. As an alternative to extension of packers, or in addition thereto, another expandable element such as the piston 45 can be extended to contact the wall of the well borehole, by appropriate positioning of the control valve 30. If no packers are extended, the extendable rib 216 alone can be used to hold the non-rotating sleeve 200 stationary.

The upper packer element 24 can be wider than the lower packer 26, thereby containing more volume. Thus, the lower packer 26 will set first. This can prevent debris from being trapped between the packers 24, 26.

The Venturi pump 38 can then be used to prevent overpressurization in the intermediate annulus 33, or the centrifugal pump 53 can be operated to remove the drilling fluid from the intermediate annulus 33. This is achieved by opening the draw down valve 41 in the embodiment shown in FIG. 3, or by opening the valves 82, 57, and 48 in the embodiment shown in FIG. 7.

If the fluid is pumped from the intermediate annulus 33, the resistivity and the dielectric constant of the fluid being drained can be constantly monitored by the sensor system 46. The data so measured can be processed down hole and transmitted up-hole via the telemetry system. The resistivity and dielectric constant of the fluid passing through will change from that of drilling fluid to that of drilling fluid filtrate, to that of the pristine formation fluid.

In order to perform the formation pressure build-up and draw down tests, the operator closes the pump inlet valve 57 and the by-pass valve 82. This stops drainage of the intermediate annulus 33 and immediately allows the pressure to build-up to virgin formation pressure. The operator may choose to continue circulation in order to telemeter the pressure results up-hole.

In order to take a sample of formation fluid, the operator could open the chamber inlet valve 58 so that the fluid in the passageway 40E is allowed to enter the sample chamber 56. The sample chamber may be empty or filled with some compressible fluid. If the sample chamber 56 is empty and at atmospheric conditions, the baffle 72 will be urged downward until the chamber 56 is filled. An adjustable choke 74 is included for regulating the flow into the chamber 56. The purpose of the adjustable choke 74 is to control the change in pressure across the packers when the sample chamber is opened. If the choke 74 were not present, the packer seal might be lost due to the sudden change in pressure created by opening the sample chamber inlet valve 58. Another purpose of the choke 74 would be to control the process of flowing the fluid into the system, to prevent the pressure from being lowered below the fluid bubble point, thereby preventing gas from evaporating from the fluid.

Once the sample chamber 56 is filled, then the valve 58 can again be closed, allowing for another pressure build-up, which is monitored by the pressure sensor. If desired, multiple pressure build-up tests can be performed by repeatedly pumping down the intermediate annulus 33, or by repeatedly filling additional sample chambers. Formation permeability may be calculated by later analyzing the pressure versus time data, such as by a Horner Plot which is well known in the art. Of course, in accordance with the teachings of the present invention, the data may be analyzed before the packers 24 and 26 are deflated. The sample chamber 56 could be used in order to obtain a fixed, controlled drawn down volume. The volume of fluid drawn may also be obtained from a down hole turbine meter placed in the appropriate passageway.

Once the operator is prepared to either drill ahead, or alternatively, to test another reservoir, the packers 24, 26 can be deflated and withdrawn, thereby returning the test apparatus 16 to a standby mode. If used, the piston 45 can be withdrawn. The packers 24, 26 can be deflated by positioning the control valve 30 to align the low pressure passageway 31 with the inflation passageway 28. The piston 45 can be withdrawn by positioning the control valve 30 to align the low pressure passageway 31 with the cylinder passageway 29. However, in order to totally empty the packers or the cylinder, the Venturi pump 38 or the centrifugal pump 53 can be used.

Once at the surface, the sample chamber 56 can be separated from the work string 6. In order to drain the sample chamber, a container for holding the sample (which is still at formation pressure) is attached to the outlet of the chamber outlet valve 62. A source of compressed air is attached to the expulsion valve 60. Upon opening the outlet valve 62, the internal pressure is released, but the sample is still in the sample chamber. The compressed air attached to the expulsion valve 60 pushes the baffle 72 toward the outlet valve 62, forcing the sample out of the sample chamber 56. The sample chamber may be cleaned by refilling with water or solvent through the outlet valve 62, and cycling-the baffle 72 with compressed air via the expulsion valve 60. The fluid can then be analyzed for hydrocarbon number distribution, bubble point pressure, or other properties. Alternatively, a sensor package can be associated with the sample chamber 56, so that the same measurements can be performed on the fluid sample while it is still downhole. Then, the sample may be discharged downhole.

Once the operator decides to adjust the drilling fluid density, the method comprises the steps of measuring the hydrostatic pressure of the well borehole at the target formation. Then, the packers 24, 26 are set so that an upper 32, a lower 34, and an intermediate annulus 33 are formed within the well borehole. Next, the well borehole fluid is withdrawn from the intermediate annulus 33 as has been previously described and the pressure of the formation is measured within the intermediate annulus 32. The other embodiments of extendable elements may also be used to determine formation pressure.

The method further includes adjusting the density of the drilling fluid according to the pressure readings of the formation so that the mud weight of the drilling fluid closely matches the pressure gradient of the formation. This allows for maximum drilling efficiency. Next, the inflatable packers 24, 26 are deflated as has been previously explained and drilling is resumed with the optimum density drilling fluid.

The operator would continue drilling to a second subterranean horizon, and at the appropriate horizon, would then take another hydrostatic pressure measurement, thereafter inflating the packers 24, 26 and draining the intermediate annulus 33, as previously set out. According to the pressure measurement, the density of the drilling fluid may be adjusted again and the inflatable packers 24, 26 are unseated and the drilling of the borehole may resume at the correct overbalance weight.

The invention herein described can also be used as a near bit blow-out preventor. If an underground blow-out were to occur, the operator would set the inflatable packers 24, 26, and have the valve 39 in the closed position, and begin circulating the drilling fluid down the work string through the open valves 80 and 82. Note that in a blowout prevention application, the pressure in the lower annulus 34 may be monitored by opening valves 39 and 48 and closing valves 57, 59, 30, 82, and 80. The pressure in the upper annulus may be monitored while circulating directly to the annulus through the bypass valve by opening valve 48. Also the pressure in the internal diameter 7 of the drill string may be monitored during normal drilling by closing both the inlet valve 39 and outlet valve 80 in the passageway 36, and opening the by-pass valve 82, with all other valves closed. Finally, the by-pass passageway 84 would allow the operator to circulate heavier density fluid in order to control the kick.

Alternatively, if the embodiment shown in FIG. 6 is used, the operator would set the first and second inflatable packers 24, 26 and then position the circulation valve 90 in the closed position. The inflatable packers 24, 26 are set at a position that is above the influx zone so that the influx zone is isolated. The shunt valve 92 contained on the work string 6 is placed in the open position. Additives can then be added to the drilling fluid at the surface, thereby increasing the density. The heavier drilling fluid is circulated down the work string 6, through the shunt valve 92. Once the denser drilling fluid has replaced the lighter fluid, the inflatable packers 24, 26 can be unseated and the circulation valve 90 is placed in the open position. Drilling may then resume.

Testing and sampling operations using the embodiments of FIGS. 13 through 16 are substantially the same as described earlier with respect to the other embodiments. However, the method of stabilizing and anchoring the tool section requires more explanation. For any of embodiment shown in FIGS. 13, 14 and 16, the tool section 16 is anchored in place within the borehole by extending the grippers 21 to engage the borehole wall. The anchored tool section is therefore less likely to move due to forces such as heave from a drilling ship or vibration from circulating drilling fluid.

The method of testing using an embodiment as shown in FIG. 15 is especially suited for tight formations, because the method uses a larger borehole wall area for testing. Instead of extending the grippers 21 and pad sealing element, 44 as in the previous embodiments, the grippers 21 and pad sealing element 44 remain retracted during test operations. Packers 24 and 26 are extended as described above to seal an intermediate annulus 33 from an upper annulus 32 and lower annulus 34. The port 43 is open to the intermediate annulus 33. Drilling fluid trapped in the intermediate annulus 33 is replaced by formation fluid 18 by pumping the drilling fluid from the intermediate annulus 33 as described above. The formation fluid 18 invades the intermediate annulus 33 when the pressure of the intermediate is reduced due to the pumping operation. Pressure testing and sampling is then conducted as described above.

The foregoing description is directed to particular embodiments of the present invention for the purpose of illustration and explanation. It will be apparent, however, to one skilled in the art that many modifications and changes to the embodiment set forth above are possible without departing from the scope and the spirit of the invention. It is intended that the following claims be interpreted to embrace all such modifications and changes.

We claim:

1. An apparatus for testing an underground formation comprising:

a) a work string disposed in a well borehole;

b) at least one independently adjustable and extendable element mounted on the work string the extendable element being capable of sealing engagement with a wall of the borehole for isolating a portion of the well at the formation;

c) at least one independently extendable gripper element_ disposed on the work string axially spaced apart from a port, the port being selectively exposed to the isolated portion of the borehole wall, wherein the at least one extendable gripper element forcibly engages the borehole wall to anchor the work string radially, axially and circumferentially while the borehole wall is engaged by the at least one extendable gripper element; and (d) a test device for testing at least one characteristic of the formation.

2. The apparatus recited in claim 1, wherein the test device comprises:

a fluid control device for controlling formation fluid flow through the port from the isolated portion of the borehole wall; and a sensor for sensing at least one characteristic of the fluid.

3. The apparatus recited in claim 2, further comprising at least one sample chamber, the at least one sample chamber being in fluid flow communication with the port.

4. The apparatus of claim 1, wherein the work string is selected from the group consisting of (i) a drill string; and (ii) a wireline.

5. The apparatus of claim 1, wherein the at least one extendable gripper element is at least two extendable gripper elements.

6. The apparatus of claim 1 wherein the extendable element is selectively extendable and selectively retractable and the at least one extendable gripper element is selectively extendable and selectively retractable.

7. The apparatus of claim 1 further comprising a plurality of selectively extendable stabilizers mounted on the work string for stabilizing the work string while the work string is translating through the borehole.

8. The apparatus of claim 7 wherein the at least one gripper element is integral to at least one of the plurality of stabilizers.

9. The apparatus of claim 1 further comprising a first selectively expandable packer device mounted on the work string and a second selectively expandable packer device mounted on the work string and spaced apart from the first selectively expandable packer device, the first and second expendable packer devices being expandable to contact the borehole wall in a sealing relationship to divide an annular space surrounding the work string into an upper annulus, an intermediate annulus and a lower annulus, wherein the at least one extendable element is located at the intermediate annulus.

10. The apparatus recited in claim 1, wherein said test port is located in said extendable element.

11. The apparatus of claim 1, wherein the port is a plurality of ports.

12. A method for testing an underground formation comprising:

a) disposing a work string in a well borehole;

b) isolating a portion of the borehole wall by extending at least one independently extendable element from the work string to sealing engagement with the wall of the borehole at the formation;

c) independently extending at least one gripper element into forceful engagement with the borehole wall axially spaced apart from a port, the port being exposed to the isolated portion of the borehole wall, wherein the at least one gripper element when extended anchors the work string radially, axially and circumferentially while the borehole wall is engaged by the at least one extendable element; and d) testing at least one characteristic of the formation at the isolated portion of the borehole well with a test device.

13. The method of claim 12, wherein testing the at least one characteristic further comprises:

i) flowing formation fluid through the port from the isolated portion of the borehole wall with a fluid control device; and ii) sensing at least one characteristic of the fluid with a sensor.

14. The method of claim 13, further comprising collecting a sample of formation fluid by flowing fluid from the port to at least one sample chamber.

15. The method of claim 12, wherein disposing a work string in a borehole comprises a work string selected from the group consisting of (i) a drill string; and (ii) a wireline.

16. The method of claim 12, wherein extending at least one gripper element is extending at least two gripper elements.

17. The method of claim 12, further comprising:

i) translating the work string through the borehole; and ii) stabilizing the work string while translating the work string through the borehole by extending a plurality of stabilizers from the work string.

18. The method of claim 17, wherein extending at least one extendable gripper element is extending at least one gripper element from an extended stabilizer.

19. A method of claim 12, further comprising:

i) expanding a first packer device from the work string into sealing engagement with the borehole wall; and ii) expanding a second packer device from the work string into sealing engagement with the borehole wall at a location spaced apart from the first packer device, wherein expanding the first and second packer devices divides an annular space surrounding the work string into an upper annulus, an intermediate annulus and a lower annulus, and wherein exposing the port is exposing the port to the intermediate annulus.

* * * * *